US011352709B1

(12) United States Patent
Trinh

(10) Patent No.: US 11,352,709 B1
(45) Date of Patent: Jun. 7, 2022

(54) HELICALLY RIBBED ELECTROPLATING BARREL

(71) Applicant: Presidio Components. Inc., San Diego, CA (US)

(72) Inventor: Hung Van Trinh, La Jolla, CA (US)

(73) Assignee: Presidio Components. Inc., San Diego, CA (US)

( * ) Notice: Subject to any disclaimer, the term of this patent is extended or adjusted under 35 U.S.C. 154(b) by 6 days.

(21) Appl. No.: 16/560,383

(22) Filed: Sep. 4, 2019

(51) Int. Cl.
*C25D 17/20* (2006.01)
*C25D 5/22* (2006.01)

(52) U.S. Cl.
CPC ..... *C25D 17/20* (2013.01); *C25D 5/22* (2013.01)

(58) Field of Classification Search
None
See application file for complete search history.

(56) References Cited

U.S. PATENT DOCUMENTS

| | | | | |
|---|---|---|---|---|
| 1,912,400 | A * | 6/1933 | O'Neill | C25D 17/22 204/201 |
| 2,480,022 | A | 8/1949 | Hogaboom | |
| 2,505,371 | A | 4/1950 | Teepe | |
| 2,624,728 | A | 1/1953 | Dubpernell et al. | |
| 2,741,463 | A | 4/1956 | Colclesser | |
| 2,766,201 | A | 10/1956 | Luther | |
| 3,649,490 | A * | 3/1972 | Nolan et al. | C25D 17/28 204/201 |
| 3,846,271 | A | 11/1974 | Singleton | |
| 4,062,752 | A | 12/1977 | Peterson | |
| 4,399,828 | A | 8/1983 | Kontos | |
| 4,559,122 | A | 12/1985 | Folco et al. | |
| 5,755,948 | A | 5/1998 | Lazaro et al. | |

* cited by examiner

*Primary Examiner* — Louis J Rufo
(74) *Attorney, Agent, or Firm* — Wood Herron & Evans LLP

(57) ABSTRACT

A rotatable electroplating barrel for electroplating articles, the electroplating barrel having a proximal end with a centrally formed aperture and a distal end with at least one helical rib extending circumferentially along a longitudinal axis and between the proximal end and the distal end. The at least one helical rib, proximal end, and distal end of the electroplating barrel are formed integrally as a unitary piece and have a contiguous perforated outer wall configured to couple directly to the proximal and distal ends, extending therearound to enclose the at least one helical rib.

23 Claims, 12 Drawing Sheets

HELICALLY RIBBED ELECTROPLATING BARREL

FIELD OF THE INVENTION

The present invention generally concerns the process of electroplating for finishing bulk articles and, more particularly, to plating barrels used in electroplating systems.

BACKGROUND OF THE INVENTION

Electroplating or electrodeposition of articles, especially small articles such as, for example, end terminals, often requires a bulk finishing electroplating system. The traditional method used to plate bulk articles is barrel plating. Barrel plating is the process in which parts are placed in a rotating mesh basket or barrel, typically made of polypropylene, and immersed in a plating bath. Typically, articles such as end terminals are electrolytically plated with a layer of nickel followed by a layer of tin, tin-lead, or gold.

Barrel plating employs perforated barrels that are usually dipped into various types of rinses and electroplating solutions while the discrete parts remain in the barrel. The barrel with the contained parts is typically rotated within the electroplating solution to which a plating current is supplied by means of electrodes such as, one or more cathodes in contact with the articles being plated and an anode immersed in the electroplating solution. As the barrel or drum is rotated, a deposit of plating is gradually built up on the parts, and when the plating has reached the desired thickness, the parts are removed from the solution and from the barrel to be washed and dried or further treated.

Common barrel designs used for barrel plating include flat-sided, oblique-type, and round plating barrels. Manufacturers of plating barrels often integrate ribs, grooves, or dimples on the barrel walls to better facilitate part agitation and turnover within the barrel. In the operation of such barrels, the parts are continually being carried up one side of the barrel as the barrel rotates until a point is reached at which they fall by gravity to a lower point, from which they are again raised to repeat the tumbling cycle of motion. Accordingly, the discrete parts are only moved around the circumference of the plating barrel. In this regard, these plating barrels have several disadvantages which adversely affects the coating performance, resulting in a high percentage of rejected parts due to bare spots and uneven plating. The random circumferential tumbling movement and loose confinement of parts in such barrels during tumbling results in uneven clumping and tumbling of parts, requiring considerable additional time for plating to be accomplished satisfactorily. Similarly, the loosely confined parts will not have sufficient electrical contact with the plating cathodes during the random, circumferential tumbling movement, resulting in inconsistent deposition of plating materials. Lastly, such barrel configurations do not effectively circulate or reintroduce new plating solution within the barrel as desired to obtain a good plating profile.

Accordingly, it is desirable to provide an improved electroplating barrel that consistently, and axially and circumferentially circulates bulk parts within the electroplating barrel, improving overall product coating performance and reducing deposition time of plating materials. In particular, it is desirable to have an electroplating barrel which provides for increased surface area exposure of each part to the plating solution. Further, it is desirable to have an electroplating barrel with improved solution circulation, facilitating the transfer of exhausted electroplating solution outwardly from within the electroplating barrel and fresh solution into the electroplating barrel.

SUMMARY OF THE INVENTION

The present invention provides a helically ribbed electroplating barrel with a cost effective structure that is easy to manufacture and configured for use with an electroplating apparatus for electroplating bulk articles. According to one aspect, the electroplating apparatus described herein is provided with a plating tank having a volume of electroplating solution, a rotatable electroplating barrel for electroplating articles contained therein, a frame including a motor housing, a drive mechanism, a support arm configured to position the electroplating barrel in the plating tank, an output gear rotatably supported by the support arm, and a sleeve assembly configured to threadably secure the electroplating barrel to the output gear.

In another aspect, the electroplating barrel is provided with a proximal end having a base and a raised internal surface with a centrally formed aperture therebetween and at least one tab projecting from the base, a distal end, at least one helical rib extending circumferentially along a longitudinal axis and between the proximal end and the distal end of the electroplating barrel, and a contiguous perforated outer wall coupled directly to the proximal and distal ends and configured to extend therearound to enclose the at least one helical rib.

In another aspect, the at least one helical rib of the electroplating barrel comprises a radially extending flange defining a height of the helical rib, the flange having a pushing surface, trailing surface, and trailing edge, and a channel projecting axially from the flange towards the proximal end, the channel having a leading edge and an axial width defined by the distance between a plane defined by the flange and a plane defined by the leading edge, and a back surface diametrically opposed from the channel.

In another aspect, the helical rib forms a pocket between the channel, pushing surface of the flange, and the perforated outer wall, configured to capture a portion of articles contained within the barrel and advance the portion of articles from the distal end to the proximal end as the barrel rotates.

In yet another aspect, the at least one helical rib of the electroplating barrel comprises a radially extending flange having a pushing surface and a diametrically opposed trailing surface, the pushing and trailing surfaces extending between an axially extending outer surface and diametrically opposed an inner surface.

In another aspect, the helical rib forms a plurality of receiving spaces along the length of the electroplating barrel between the pushing surface, opposing trailing surface, and perforated outer wall, configured to capture a portion of articles contained within the barrel and advance the portion of articles from the distal end to the proximal end as the barrel rotates.

In yet another aspect, a method is provided for electroplating articles with an electroplating barrel. The method includes providing a plating tank containing a volume of electroplating solution, providing an electroplating barrel comprising a proximal end and a distal end with at least one helical rib extending circumferentially along a longitudinal axis therebetween and defining a central axial opening, and a contiguous perforated outer wall coupled directly to the proximal and distal ends and configured to extend therearound to enclose the at least one helical rib wherein a pocket is formed between the at least one helical rib and the perforated outer wall. Further providing an electroplating apparatus having a frame including a motor housing, a drive mechanism operatively coupled to an output gear and rotatably supported by a support arm and configured to position the electroplating barrel in the plating tank where the electroplating barrel is operatively coupled to the output gear with a sleeve assembly, filling the electroplating barrel with articles to be electroplated and coupling the electroplating barrel containing the articles to be electroplated to the output gear and activating the drive mechanism, rotating the barrel about the longitudinal axis wherein articles are captured by the pocket at the distal end and advanced from the distal end to the proximal end of the electroplating barrel and disposing articles into the central axial opening to be recirculated from the proximal end back to the distal end of the electroplating barrel through the central axial opening.

BRIEF DESCRIPTION OF THE DRAWINGS

The accompanying drawings, which are incorporated in and constitute a part of this specification, illustrate embodiments of the invention and, together with a general description of the invention given above, and the detailed description of the embodiments given below, explain the principles of the invention. Referring particularly to the drawings for the purpose of illustration only and not to limit the scope of the invention in any way, these illustrations follow.

DETAILED DESCRIPTION

The following description is of the best mode presently contemplated for the carrying out of the invention. This description is made for the purpose of illustrating the general principles of the invention, and is not to be taken in a limiting sense. The scope of the invention is best determined by reference to the appended claims.

Various non-limiting embodiments will now be described to provide an overall understanding of the principles of the structure, function, and use of the electroplating barrel disclosed herein. One or more examples of these non-limiting embodiments are illustrated in the accompanying drawings. Those of ordinary skill in the art will understand that apparatus and methods specifically described herein and illustrated in the accompanying drawings are non-limiting embodiments. The features illustrated or described in connection with one non-limiting embodiment may be combined with the features of other non-limiting embodiments. Such modifications and variations are intended to be included within the scope of the present disclosure. As used herein, the term barrel is used to broadly refer to the rotating vessel that contains a bulk workload for processing, which may otherwise be referred to by a person having ordinary skill in the art as, for example, a basket, cage, or chamber.

Figure 1:
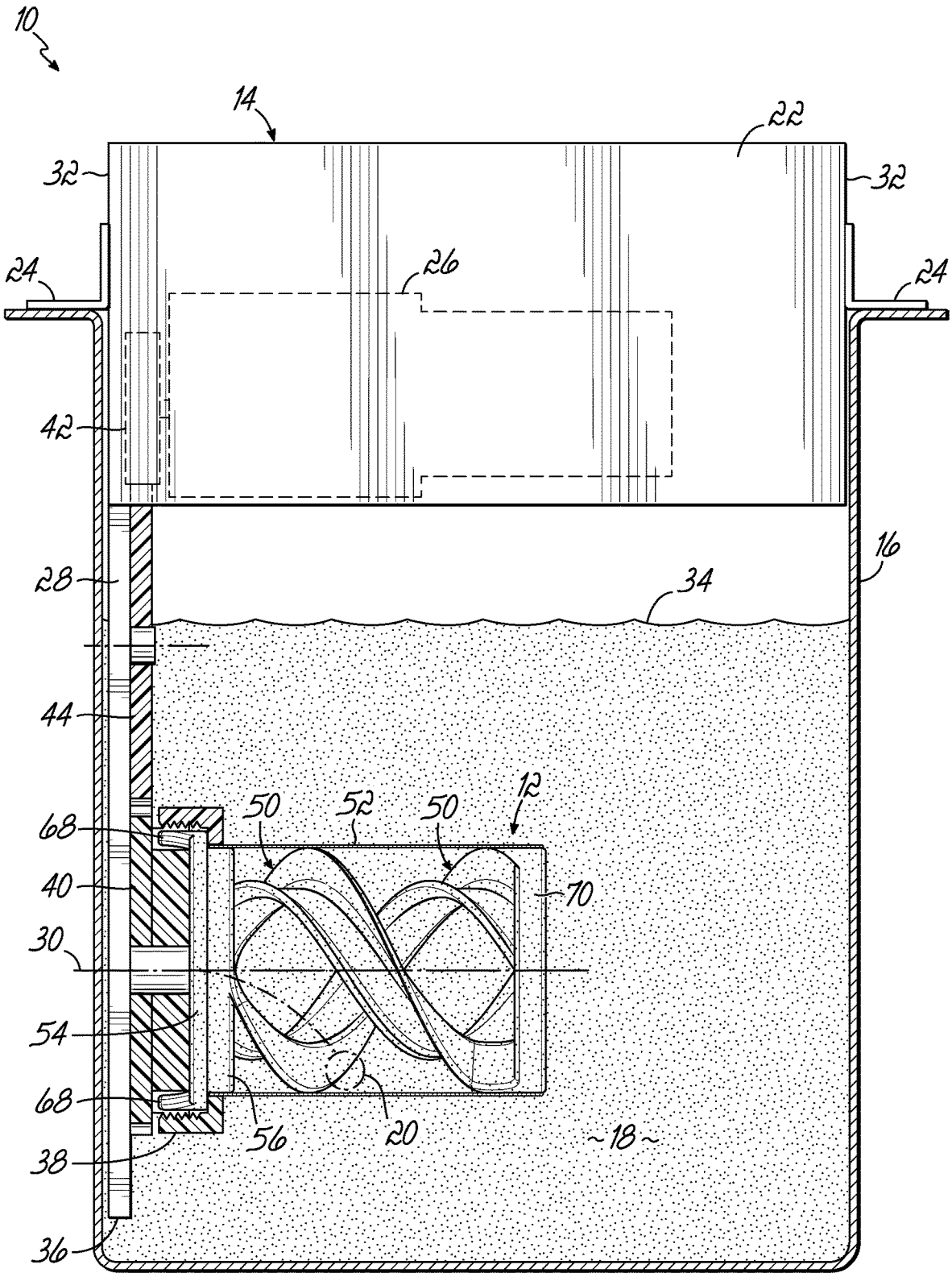
FIG. 1 is a partial sectional side view of an exemplary electroplating apparatus according to one embodiment of the present invention.

With reference to FIG. 1, an exemplary electroplating apparatus 10 according to one embodiment of the present invention is illustrated in which the electroplating barrel or drum of the present application has particular utility. The exemplary electroplating apparatus 10 includes an electroplating barrel or drum 12 configured to contain articles for electroplating therein, a frame 14 configured to rotatably support the electroplating barrel 12, a plating tank 16 containing an electroplating solution 18 (e.g., an electrolytic solution that generally contains ions, atoms or molecules that have lost or gained electrons, and is electrically conductive), and a metal contact member 20. As shown, the plating tank 16 functions to hold the electroplating solution 18 and contains a suitable volume of electroplating solution 18 so that when the electroplating apparatus 10 is operated, the electroplating barrel 12 is entirely submerged in the electroplating solution 18. The plating tank 16 has a generally rectangular shape having a flat bottom wall and vertically extending side walls and is formed from, for example, fiberglass, polyvinyl chloride, or metal lined with a relatively heavy corrosion resistant and non-electrically conductive material such as a suitable rubber or plastic. However, the particular structural details of the plating tank 16 form no part of the present invention and could vary widely. In the embodiment shown, the plating tank 16 is configured to support the frame 14 such that the electroplating barrel 12 is disposed in the plating tank 16.

As shown, the frame 14 further includes a motor housing 22 with a plurality of horizontal supports 24 configured to extend across the upper end of the plating tank 16 and used to support the frame 14, a drive mechanism 26 disposed within the motor housing 22, and a support arm 28 configured to rotatably support the electroplating barrel 12 about an axis of rotation 30, as described in greater detail below. In the exemplary embodiment, the drive mechanism 26 may include an electric motor, such as, for example, an AC or DC brushless motor, a direct drive motor, servo motor, or the like. As shown, the motor housing 22 is generally rectangular in shape and may be configured to be partially disposed within the upper end of the plating tank 16. In this regard, the horizontal supports 24 may be positioned along a side 32 of the motor housing 22 such that, when the horizontal supports 24 engage the plating tank 16, the motor housing 22 remains above a surface 34 of the electroplating solution 18. However, the present invention need not be limited by the construction of the motor housing 22 shown in FIG. 1, and may employ any other suitable motor housing 22 that can house the drive mechanism 26 and rotatably support the electroplating barrel 12.

With continued reference to FIG. 1, the support arm 28 is attached to the motor housing 22 adjacent to one side 32 thereof. The support arm 28 extends longitudinally and downwardly from the motor housing 22 to position an end surface 36 of the support arm 28 proximate to the bottom of the plating tank 16. In the embodiment shown, the support arm 28 includes an output gear 40 rotatably supported by the support arm 28, adjacent to the end surface 36 thereof. As described in additional detail below, the output gear 40 further includes a coupling sleeve 38 configured to operatively couple the electroplating barrel 12 to the output gear 40 such that the electroplating barrel 12 extends outwardly and away from the output gear 40 and support arm 28, in a direction towards the center of the plating tank 16. In this regard, the support arm 28 is configured to position the electroplating barrel 12 within the plating tank 16 such that the electroplating barrel 12 is immersed in the plating solution. By way of example and without limitation, in one embodiment, the support arm 28 may be configured to position the electroplating barrel 12 between about 20% and 80% below the surface 34 of the electroplating solution 18 during operation. In a preferred embodiment, the support arm 28 may be configured to position the electroplating barrel 12 between about 40% and 60% below the surface 34 of the electroplating solution 18 during operation.

The support arm 28 may further include one or more gears configured to transmit rotational motion from the drive mechanism 26 to the output gear 40 and thus the electroplating barrel 12. In this regard, the drive mechanism 26 may include a driver gear 42 directly driven by the drive mechanism 26. In the embodiment shown, the support arm 28 also includes a driven gear 44 rotatably supported by the support arm 28 and positioned between the output gear 40 and the driver gear 42 of the drive mechanism 26. To this end, the driven gear 44 engages both the driver gear 42 and the output gear 40. As a result of the engagements described above, the rotational or motive force provided by the drive mechanism 26 is transferred to the driven gear 44, and from the driven gear 44 to the output gear 40 to rotate the electroplating barrel 12 coupled thereto, as described in further detail below. However, the invention is not so limited, as other possible configurations for transmitting rotational motion to the electroplating barrel 12 are well understood in the art, such as including more or less driven or drive gears, relocating the drive mechanism 26, or having a direct drive configuration. Furthermore, the electroplating barrel 12 may be belt drive or driven by a rubber O-ring, for example.

The elements that form the frame 14 may be formed from a variety of materials. For example, the motor housing 22, horizontal supports 24 and support arm 28 may be formed or molded from suitable engineering plastics, including, for example, polypropylene, polyethylene or other suitable plastics. Alternatively, these elements could be formed from metal. In this regard, any element formed from metal may function as an electrode between an electrically connected part and the plating solution. Alternatively, any element not functioning as an electrode may be lined with a relatively heavy corrosion resistant and non-electrically conductive material such as a suitable rubber or plastic. However, the invention is not so limited as the elements that form the frame 14 may be formed from other suitable materials.

Figure 2A:
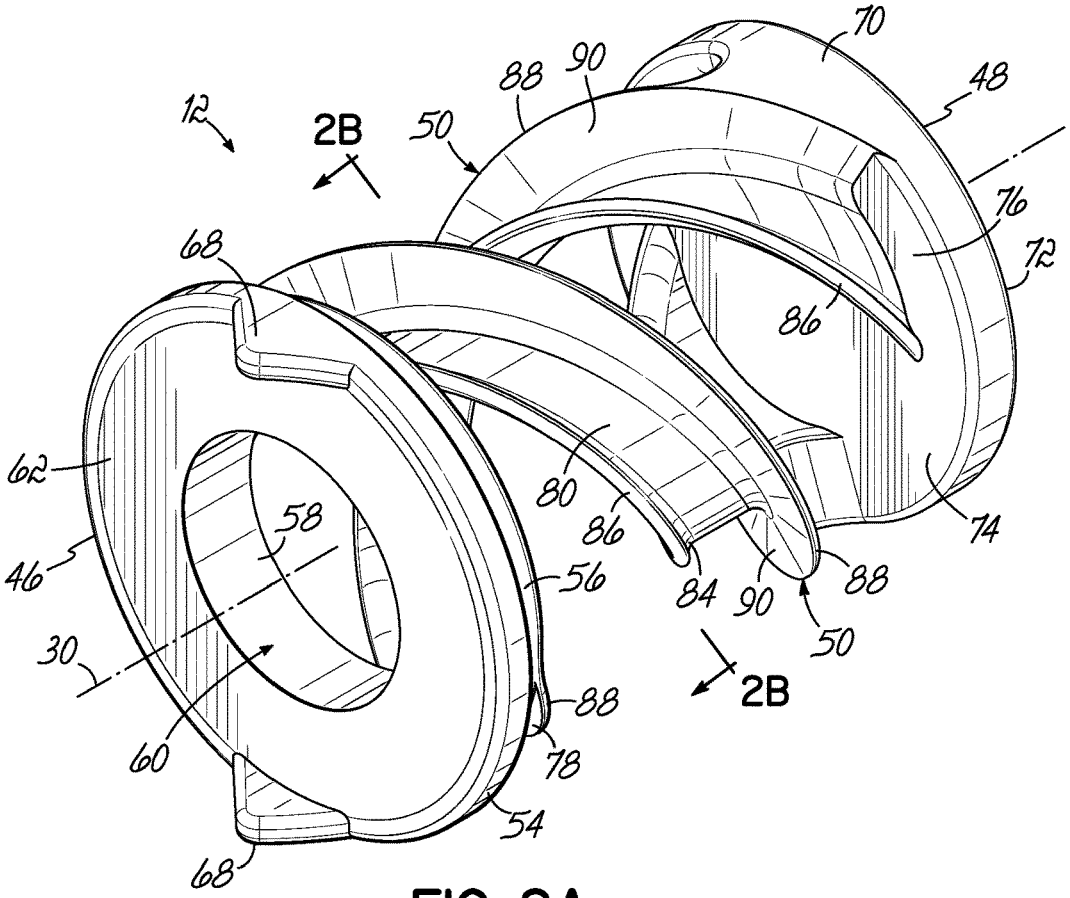
FIG. 2A illustrates a perspective view of an electroplating barrel having two helical ribs according to one embodiment of the present invention.
Figure 2B:
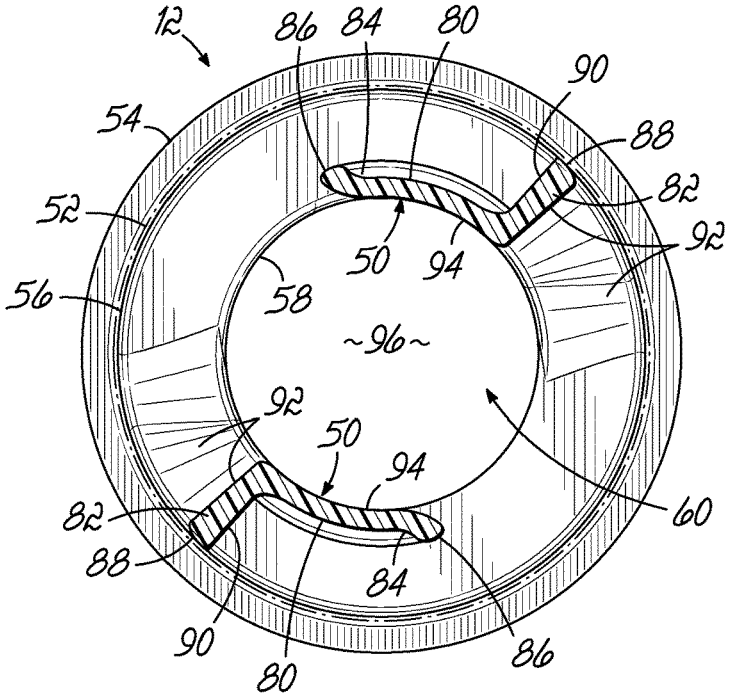
FIG. 2B illustrates a sectional view taken along line 2B-2B of FIG. 2A.
Figure 2C:
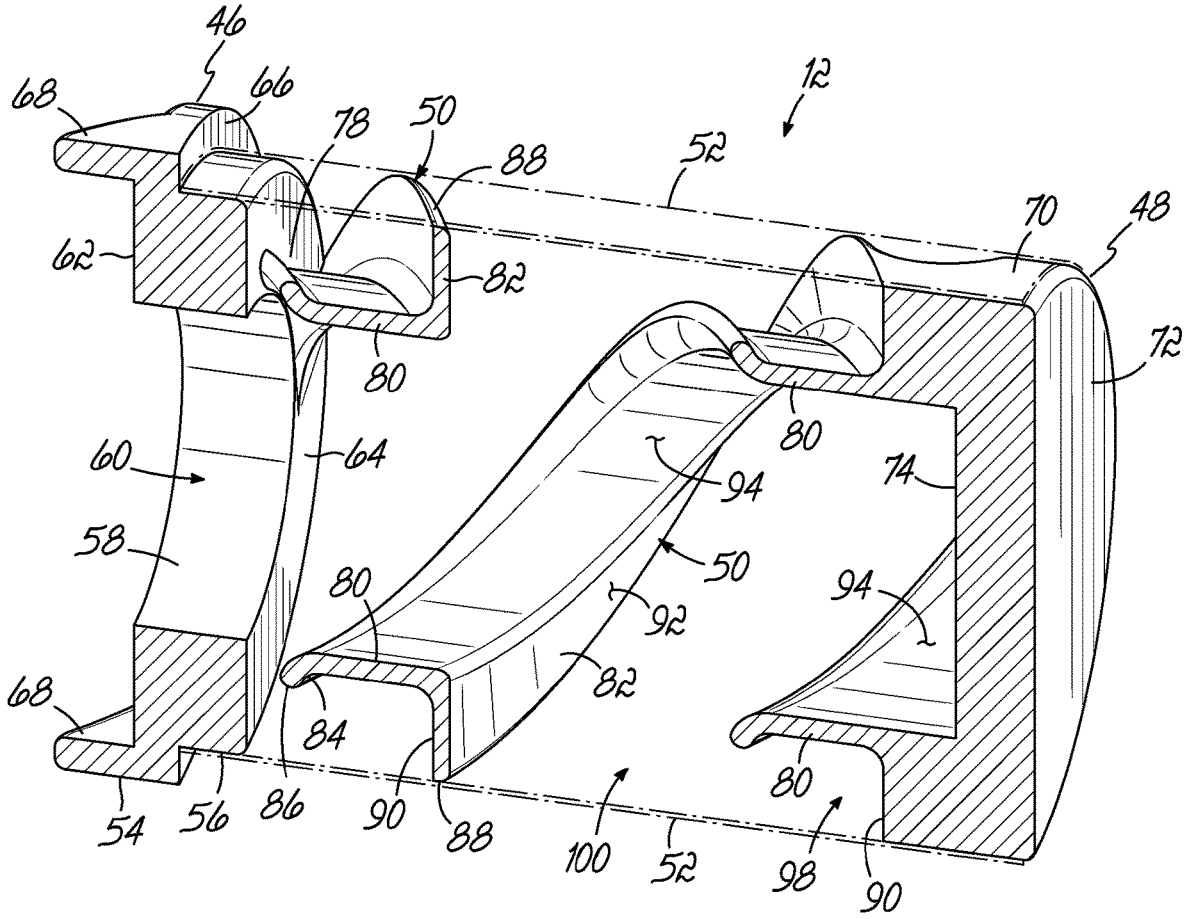
FIG. 2C illustrates a cross-sectional side view of the embodiment shown in FIG. 2A.

Referring now to FIGS. 2A-2C, an exemplary electroplating barrel 12 according to one embodiment of the present invention is shown. The electroplating barrel 12 includes a proximal end 46, a distal end 48, and one or more helical ribs 50 extending helically along a longitudinal axis of rotation 30, and between the proximal and distal ends 46, 48, of the electroplating barrel 12, as described in further detail below. In the embodiment shown, the helical ribs 50, proximal end 46, and distal end 48 of the electroplating barrel 12 may be formed integrally as a unitary piece. In another embodiment, the helical rib(s) 50 may be separately formed from the ends 46, 48, and fixed thereto. The elements forming the electroplating barrel 12 may be formed from suitable material that is chemically and physically resistant to use in an electroplating bath, such as, for example, polypropylene, polyethylene or other suitable engineering plastics. However, the invention is not so limited as the elements that form the electroplating barrel 12 may be formed from other suitable materials. The electroplating barrel 12 may further include a contiguous perforated outer wall 52 extending between the proximal and distal ends of the electroplating barrel 12 and configured to wrap circumferentially around the electroplating barrel 12 and be affixed thereto. In this regard, the outer wall 52 generally forms a cylinder to surround the helical ribs 50 and enclose the electroplating barrel 12, as will be described in more detail below.

In the embodiment shown, the proximal end 46 of the electroplating barrel 12 includes a first and second 54, 56, generally cylindrical outer surface and a generally cylindrical and longitudinally extending inner surface 58 defined by a central aperture 60, extending between a base surface 62 and an internal, raised surface 64. The central aperture 60 may be used to load articles into the electroplating barrel 12 to be electroplated, as well as remove electroplated articles therefrom. The width of the base surface 62 is defined by a planar annular ring between the inner surface 58 and the first outer surface 54. Similarly, the width of the internal surface 64 is defined by a planar annular ring between the inner surface 58 and the second outer surface 56. As shown, the second outer surface 56 is positioned radially inwardly relative to the first outer surface 54 to define a shoulder 66 configured to operatively engage with a portion of the coupling sleeve 38, as described in greater detail below.

As best shown in FIG. 2A, the proximal end 46 further includes a plurality of longitudinally extending tabs 68, projecting axially from the base surface 62, and adjacent to the first outer surface 54, and are smooth, continuous extensions of the outer surface 54. In the embodiment shown, the proximal end 46 of the electroplating barrel 12 includes two keys or tabs 68 diametrically opposed or circumferentially off-set from one another by approximately 180 degrees. However, other degrees or positions of the tabs 68 are also possible. Each tab 68 may be generally triangular in shape, having angled sides extending to a generally rounded point. However, other shapes may also be used, such as, for example, square-shaped or rectangular-shaped tabs. The electroplating barrel 12 may also include more or less tabs 68, for example, without departing from the scope of the general inventive concept. As described in further detail below, the tabs 68 are configured to operatively engage the output gear 40 via the coupling sleeve 38.

The distal end 48 of the electroplating barrel 12 is substantially cylindrical in shape, having an outer surface 70 extending between an end surface 72 and an internal surface 74. As shown, the diameter of the distal end 48 is substantially similar to the outer diameter of the internal surface 64 of the proximal end 46. Similarly, the outer surface 70 of the distal end 48 may also be substantially similar in shape to the second outer surface 56 of the proximal end 46. In this regard, the outer wall 52 may extend between the outer surface 70 of the distal end 48 and the second outer surface 56 of the proximal end 46 to generally define an internal volume of the electroplating barrel 12, as described in further detail below. In an alternative embodiment (not shown), the distal end 48 may include a centrally formed aperture that is substantially similar in shape to the central aperture 60 formed in the proximal end 46. In this embodiment, the end surface 72 may be covered by a perforated outer wall segment, having a similar construction as the above-mentioned outer wall 52, configured to attach to the end surface 72 of the distal end 48 and cover the aperture. Accordingly, one benefit of having an additional opening in the electroplating barrel 12 would be an increased transfer of exhausted electroplating solution outwardly from within the electroplating barrel 12 and fresh solution into the electroplating barrel 12.

With continued reference to FIGS. 2A-2B, the outer wall 52 may be attached to, and extend between, the proximal and distal ends 46, 48, and configured to wrap around the perimeter of the second outer surface 56 and outer surface 70 of the proximal and distal ends 46, 48, respectively. In this regard, the outer wall 52 forms a generally cylindrical shape and, in addition to the proximal and distal ends 46, 48, generally defines the internal volume of the electroplating barrel 12. The outer wall 52 may further include many spaced perforations formed therein, configured to retain articles within the electroplating barrel 12, yet allow for the transfer of exhausted electroplating solution outwardly from within the electroplating barrel 12 and fresh solution into the electroplating barrel 12. The size and spacing of the perforations may vary widely depending on, for example, the size of the articles to be electroplated. The outer wall 52 may be formed of non-conductive woven-filament materials, such as, for example, polypropylene, synthetic resin coated wire mesh, synthetic resin man-made fibers, textile materials coated with synthetic resin, or any other suitable wire or mesh material. The outer wall 52 may be attached or sealed to the electroplating barrel 12 by gluing, high frequency welding, ultrasonic welding or any other suitable means for affixing the outer wall 52 to the electroplating barrel 12. In an alternative embodiment, the outer wall 52 may be attached to the electroplating barrel 12 at other locations, such as, for example, the helical rib(s) 50.

In the embodiment shown, the electroplating barrel 12 includes helical ribs 50 extending between the proximal and distal ends 46, 48, such that, the helical ribs 50, proximal end 46, and distal end 48 are integrally formed together as a unitary piece. As shown, the helical ribs 50 may extend helically or spiral along the longitudinal axis of rotation 30 of the electroplating barrel 12, extending from an inlet 76 formed on the inner surface 74 of the distal end 48 to an outlet 78 formed on the inner surface 58 of the proximal end 46. In this regard, each helical rib 50 may extend for at least one full revolution (e.g., 360 degrees) about the longitudinal axis of rotation 30 of the electroplating barrel 12. In alternative embodiments, the helical ribs 50 may extend for greater than one full revolution (e.g., greater than 360 degrees), for example, a plurality of revolutions, or for less than one full revolution (e.g., less than 360 degrees) about the longitudinal axis. To this end, it will be understood that the term "spiral," and "helically," as used herein, encompasses any three-dimensional path extending parallel to and circumferentially about the longitudinal axis of rotation 30 of the electroplating barrel 12. Furthermore, it will be understood that "spiral," and "helically" are not limited in shape to a path defining a constant angle relative to the longitudinal axis 30, nor to a path defining a constant or uniformly changing diameter about the longitudinal axis 30.

As shown, each helical rib 50 may be formed with an outwardly facing channel 80 having a rounded or curved surface 84 defining a leading edge 86 wherein the channel 80 may project from an end of a flange 82. In this regard, the flange 82 may extend outwardly from the channel 80 to define a trailing edge 88, the flange 82 further including a pushing surface 90 and a diametrically opposed trailing surface 92. The channel 80 may have a predetermined axial width defined by the distance between a plane defined by the flange 82 and a plane defined by the leading edge 86. In a preferred embodiment, elements of the helical rib 50, for example, the edges 86, 88, and the channel 80, may be smoothly curved. The smooth, curved surfaces minimize damage to articles in the electroplating barrel 12 during operation. As shown, the flange 82 is generally perpendicular to the channel 80, having a predetermined radial height configured to radially space the channel 80 inwardly from the outer wall 52. The height may be, for example, the distance between a plane tangential to the trailing edge 88 of the flange 82 and a plane defined by a back surface 94 of the channel 80. The trailing edge 88 of the flange 82 may be adjacent or abut the outer wall 52 such that articles may not pass therebetween. In an alternative embodiment, the outer wall 52 may be secured to the flange 82 of the helical rib 50 at the trailing edge 88. As shown, the radial height of the flange 82 and the axial width of the channel 80 remain substantially constant along the entire length of the electroplating barrel 12. However, the width of the channel 80 and the height of the flange 82 may be smoothly tapered at the inlet 76 where the helical rib 50 extends from the internal surface 74 of the distal end 48, and similarly tapered at the outlet 78 at the proximal end 46. As the helical rib 50 extends around the longitudinal axis of rotation 30, the pitch of the helical rib 50 and, more particularly the flange 82, may vary so that the channel 80 generally faces the outer wall 52 to capture articles therebetween, as described in more detail below. In this regard, the helical rib 50 is generally "L" shaped such that the pushing surface 90 of the flange 82 faces the proximal end 46 of the electroplating barrel 12, and the channel 80 faces the outer wall 52.

As best shown in FIG. 2B, a back surface 94 of each helical rib 50 spirals about the longitudinal axis of rotation 30 and defines a central axial opening or cavity 96 which extends the length of the electroplating barrel 12, from the distal end 48 to the proximal end 46. The central axial opening 96 is generally cylindrical in in shape and, in the embodiment shown, corresponds to the shape of the central aperture 60 formed in the proximal end 46. In this regard, as the electroplating barrel 12 is rotated during operation, for example, the central axial opening 96 facilitates axial movement of the articles contained within the electroplating barrel 12 from the proximal end 46 to the distal end 48, as described in greater detail below. In the embodiment shown, the radial height of the flange 82, and thus the helical rib 50, generally corresponds to the wall thickness of the internal surface 64 of the proximal end 46. Accordingly, the helical rib 50 may project from the internal surface 74 of the distal end 48 such that the trailing edge 88 of the flange 82 is coplanar with the outer surface 70, and forms a smooth, continuous extensions of the outer surface 70 at both the inlet and outlet 76, 78. In this regard, the extension of the outer surface 70 may be flared and taper to the trailing edge 88 such that the edges remain rounded and smoothly curved. Likewise, the helical rib 50 may project from the internal surface 64 of the proximal end 46 such that the trailing edge 88 of the flange 82 is also coplanar with the second outer surface 56, and forms a smooth, continuous extensions of the second outer surface 56.

With continued reference to FIGS. 2A-2C, the helical rib 50 forms a pocket 98 between the channel 80, flange 82, and the outer wall 52 of the electroplating barrel 12 configured to capture articles therein. Similarly, the pushing surface 90 of a portion of one helical rib 50 cooperates with the opposing trailing surface 92 of a portion of another helical rib 50 and the outer wall 52, to form a receiving space 100 therebetween. In the embodiment shown, the size of receiving space 100 is larger than the size of the pocket 98. The pocket 98 and receiving space 100 cooperate to push articles captured therebetween from the distal end 48 to the proximal end 46 of the electroplating barrel 12 during operation. As shown, the size of the pocket 98 corresponds to the height of the flange 82 and the width of the channel 80. However, in alternative embodiments, the pocket 98 may be larger, smaller, or have a different shape, as discussed in further detail below. In this regard, the size of the receiving space 100 generally corresponds to the pitch of the helical rib 50 which may be constant or variable, for example. The receiving space 100 may also vary in size depending on the revolutions of the helical rib 50, as well as the radial height of the flange 82. Furthermore, the size of the receiving space 100 may be influenced by the number of helical ribs 50 within the electroplating barrel 12, as described in additional detail below. In the embodiment shown, the receiving space 100 generally increases in size from the inlet 76 and decreases in size near the outlet 78 of the helical rib 50. Accordingly, this configuration facilitates the recirculation of articles within the electroplating barrel 12 during operation.

In the embodiment shown, the helical ribs 50 extend helically in a clockwise direction around the axis of rotation 30. In this regard, the construction of the helical rib 50 is configured to push articles from the distal end 48 to the proximal end 46 such that the articles are recirculated while the electroplating barrel 12 is rotating in a counterclockwise direction. However, in an alternative embodiment, the helical ribs 50 may extend helically in a counterclockwise direction around the axis of rotation 30. Accordingly, in this embodiment, the helical ribs 50 may be configured in a similar manner to push articles from the distal end 48 to the proximal such that the articles are recirculated in the electroplating barrel 12 while being rotated in a clockwise direction.

As described above, the electroplating barrel 12 is operatively coupled to the electroplating apparatus 10 at the output gear 40, which is configured to rotate the electroplating barrel 12 about the axis of rotation 30. In this regard, and referring now to FIG. 3A, with continued reference to FIG. 1, additional features of the output gear 40 will now be described. The output gear 40 may further include a raised surface 102, centrally located and projecting outwardly along the axis of rotation 30 and having a side surface 104. As shown, the raised surface 102 is generally cylindrical in shape, having a diameter smaller than that of the output gear 40. In this regard, the raised surface 102 and the output gear 40 share the same axis of rotation 30. The side surface 104 is provided with threads 106 such that the coupling sleeve 38 may be threadably joined thereto, as described in further detail below. As shown, the raised surface 102 generally corresponds to the shape of the proximal end 46 of the electroplating barrel 12 and is configured to receive the electroplating barrel 12 thereupon, such that the raised surface 102 abuts the base surface 62 of the proximal end 46 of the electroplating barrel 12. In this regard, the raised surface 102 may include a plurality of recesses 108 adjacent to the perimeter of the raised surface 102, configured to receive the tabs 68 of the electroplating barrel 12 therein. In the embodiment shown, the raised surface 102 includes two recesses 108, circumferentially off-set from one another by approximately 180 degrees around the perimeter of the raised surface 102. The recesses 108 are configured to wholly and frictionally receive the tabs 68 of the electroplating barrel 12 therein. Thus, when the tabs 68 are fully received within the recesses 108, the base surface 62 of the electroplating barrel 12 abuts the raised surface 102.

Figure 3A:
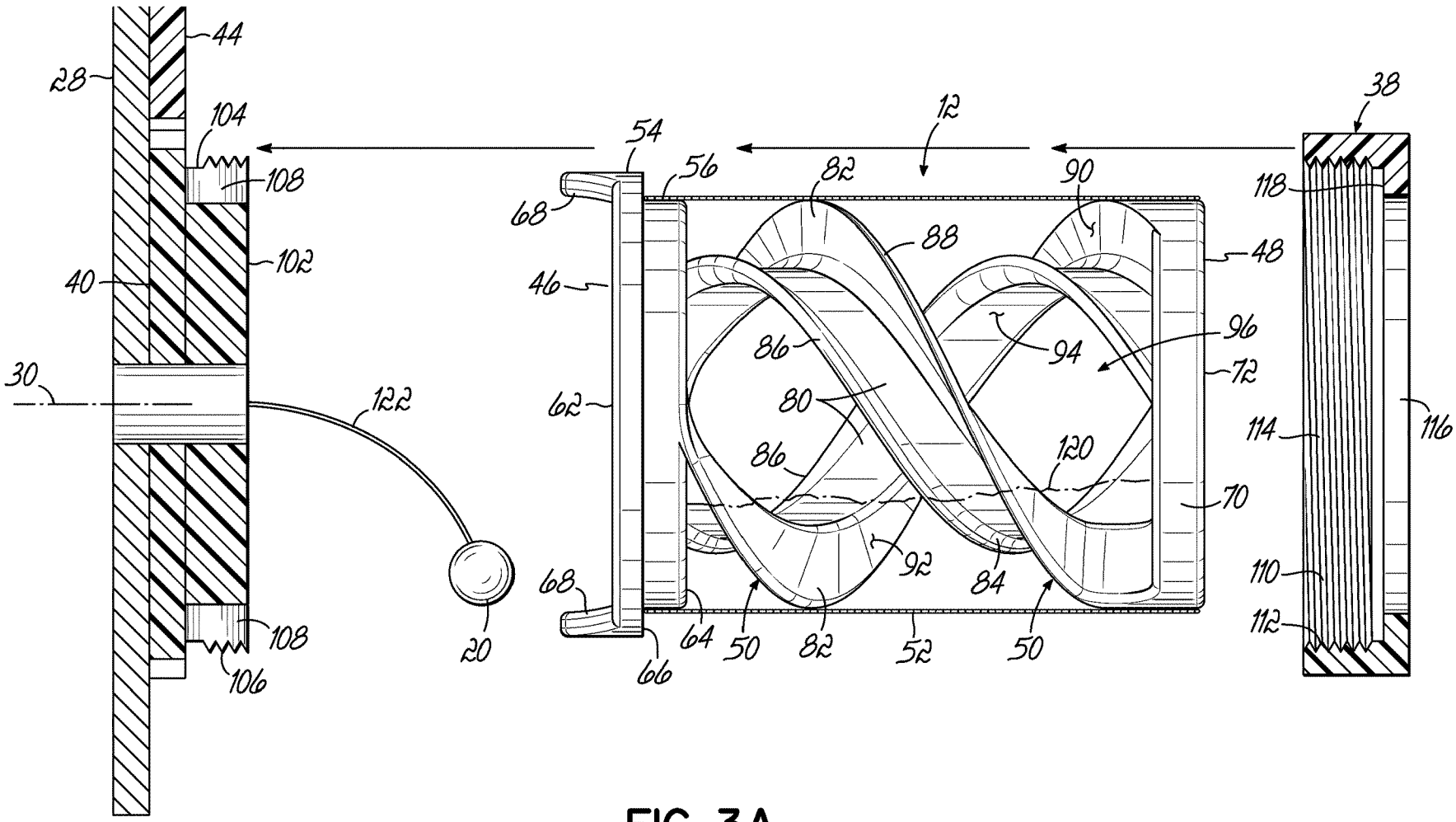
FIG. 3A is a partial cross-sectional side view of the electroplating apparatus of FIG. 1, illustrating assembly of the electroplating barrel of FIG. 2A.
Figure 3B:
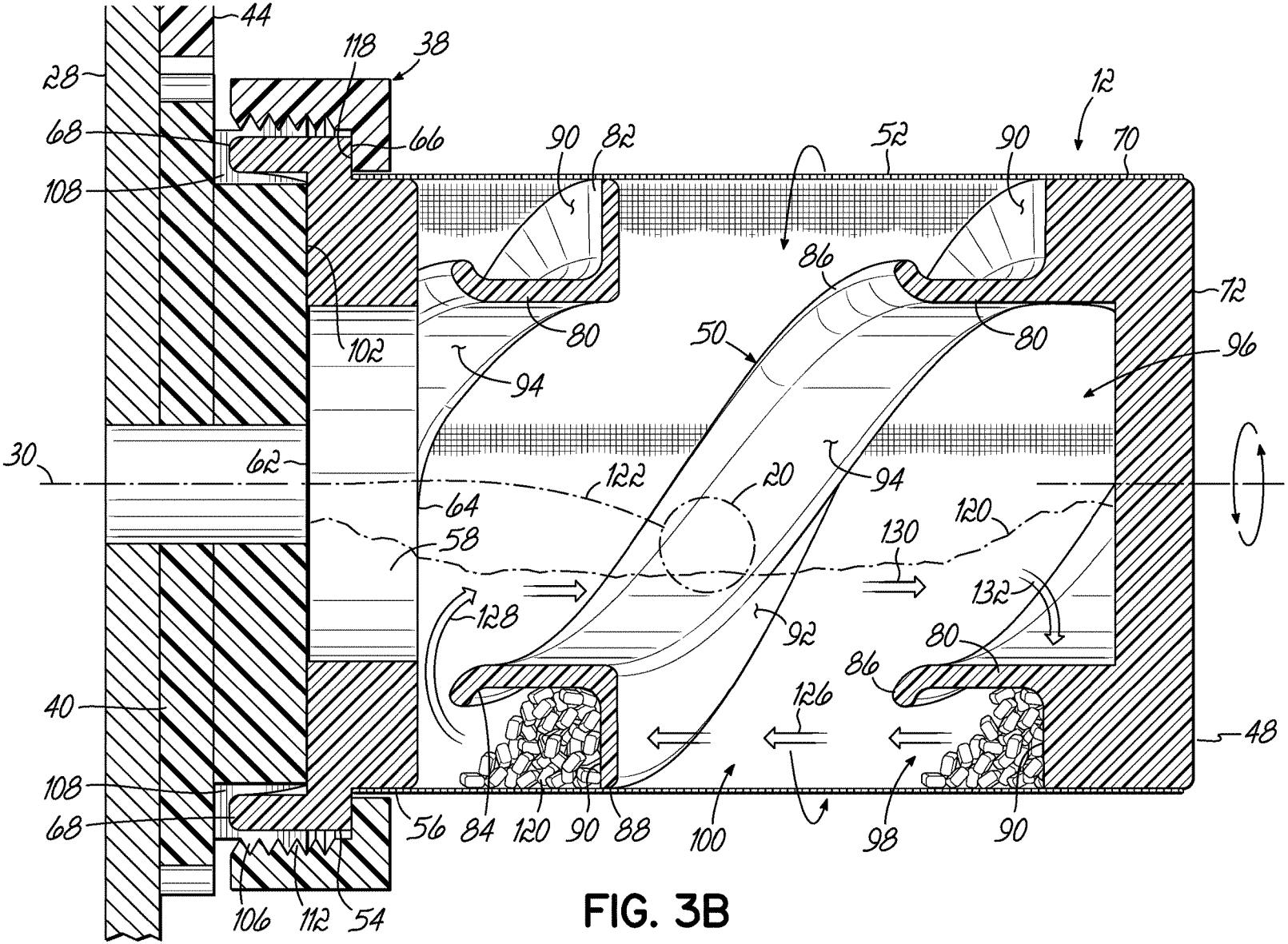
FIGS. 3B-3C are cross-sectional side views of the electroplating apparatus of FIG. 3A, illustrating the electroplating barrel of FIG. 2A in operation.

When the tabs 68 of the electroplating barrel 12 are fully inserted and engaged with the corresponding recess 108, the coupling sleeve 38 is configured to fixedly couple the electroplating barrel 12 to the output gear 40. In this regard, the coupling sleeve 38 includes an inner surface 110 provided with threads 112 and configured to threadably receive the raised surface 102 of the output gear 40 therein through a first central aperture 114. The coupling sleeve 38 includes a second central aperture 116 wherein the first and second apertures 114, 116, are separated by a shoulder 118. As shown in FIGS. 3A-3B, the second aperture 116 is sized to closely receive the distal end 48 and a portion of the second outer surface 56 of the proximal end 46 of the electroplating barrel 12 therethrough. In this regard, when the electroplating barrel 12 is engaged with the raised surface 102, and the tabs 68 fully engaged with each the corresponding recess 108, the coupling sleeve 38 is slid downwardly along the electroplating barrel 12. When the threads 106 of the raised surface 102 are received within the first aperture 114, rotation causes the threads 112 of the first aperture 114 to engage the threads 106 of the raised surface 102. By continued rotation, the coupling sleeve 38 and the raised surface 102 are threadably joined together such that the shoulder 118 of the coupling sleeve 38 engages the shoulder 66 of the electroplating barrel 12. In this regard, the electroplating barrel 12 is coupled to the output gear 40 such that when the output gear 40 rotates, the recesses 108 engage the tabs 68 and rotate the electroplating barrel 12. Accordingly, the axial pressure exerted by the coupling sleeve 38 on the shoulder 66 of the electroplating barrel 12 prevents the tabs 68, and thus the electroplating barrel 12, from disengaging the recesses 108 during operation.

With continued reference to FIGS. 3A-3D, operation of the electroplating apparatus 10 and, more specifically, the electroplating barrel 12 will be described in greater detail. Although operation of the electroplating device is illustrated with the electroplating barrel 12 of one embodiment, this is not to be taken in a limiting sense and it will be understood that alternative embodiments of the electroplating barrel 12 may be similarly operated. FIG. 3A shows an enlarged view of an exemplary embodiment of the electroplating barrel 12, output gear 40, and coupling sleeve 38 in a disassembled state. As shown in FIGS. 3A-3D, the electroplating barrel 12 may be partially filled with articles 120 to be electroplated, creating a bed of articles in the electroplating barrel 12. As discussed above, the articles 120 are introduced into the electroplating barrel 12 through the central aperture 60 formed in the proximal end 46. By way of example and without limitation, in one embodiment, the electroplating barrel 12 may be partially filled between about 10% and 70% with articles 120 during operation. In a preferred embodiment, the electroplating barrel 12 may be between about 30% and 50% filled with articles 120 during operation.

The metal contact member 20 is attached to a flexible insulated electrical conductor cable or wire 122 configured to pass electrical current from a source to the contact member. In the embodiment shown, the metal contact member 20 (which may alternatively be referred to as a cathode) is generally spherical in shape and may be formed of any suitable material capable of passing electrical current to the articles 120 being electroplated. However, the particular construction of the contact member 20 forms no part of the present invention and could vary widely. As best shown in FIG. 3B, when the electroplating barrel 12 is coupled to the output gear 40, the cable 122 is of sufficient length to position the contact member generally within the confines of the electroplating barrel 12 and, more particularly, within the central axial opening 96 of the electroplating barrel 12. For example, the cable 122 may be configured to position the metal contact member 20 within the central axial opening 96 and halfway between the proximal and distal ends 46, 48, of the electroplating barrel 12.

When the electroplating barrel 12 has been filled with a predetermined quantity of articles 120 to be electroplated, the electroplating barrel 12 may be coupled to the output gear 40 via the coupling sleeve 38 as described above. Once coupled, the electroplating barrel 12 may be disposed in the plating tank 16 and electroplating solution 18, as shown in FIG. 1. In the embodiment shown, the electroplating barrel 12 may be operated in a substantially horizontal position or at an angle. For example, in one embodiment, the support arm 28 may be configured to elastically deflect under an end load from the weight of the electroplating barrel 12 and the articles 120 contained therein, positioning the axis of rotation 30 of electroplating barrel 12 at an angle 124, as shown in FIG. 3D. In some embodiments, the electroplating apparatus 10 may be configured to rigidly position the axis of rotation 30 of the electroplating barrel 12 at an angle. In the embodiment shown, the angle 124 at which the electroplating barrel 12 may be positioned is acute from the horizontal axis of rotation 30. In this manner, the angled axis of rotation 30 of the electroplating barrel 12 is angled downward towards the bottom of the plating tank 16, positioning the distal end 48 of the electroplating barrel 12 lower than the proximal end 46. In this regard, the angle 124 of the electroplating barrel 12 facilitates axial movement of articles 120 along the central axial opening 96 of the electroplating barrel 12, as described in more detail below. By way of example and without limitation, in one embodiment, the angle 124 of the electroplating barrel 12 may be between about 1 and 30 degrees. In a preferred embodiment, the angle 124 may be between about 1 and 15 degrees and, even more preferably, between 2 and 5 degrees.

Figure 3C:
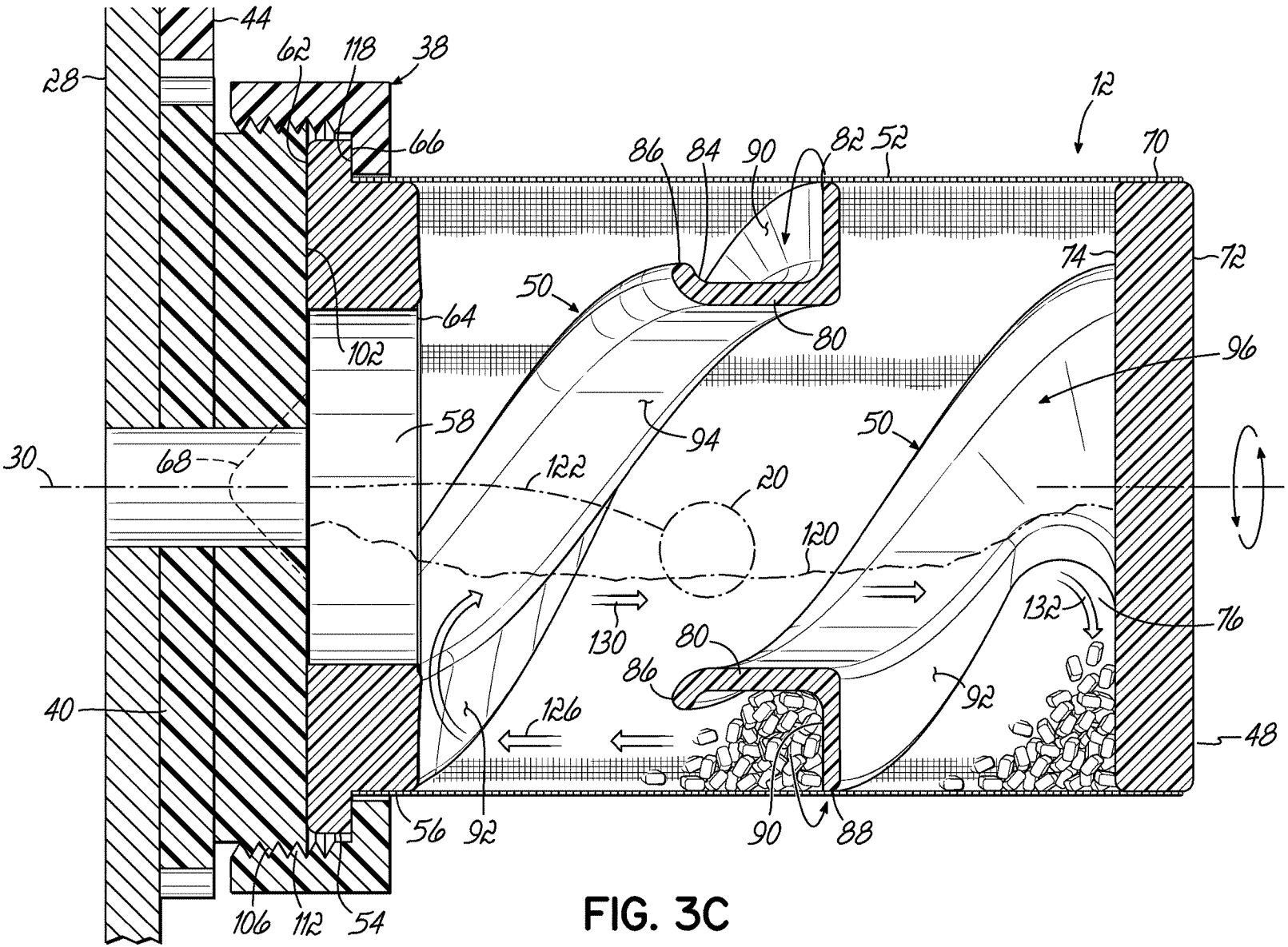
Figure 3D:
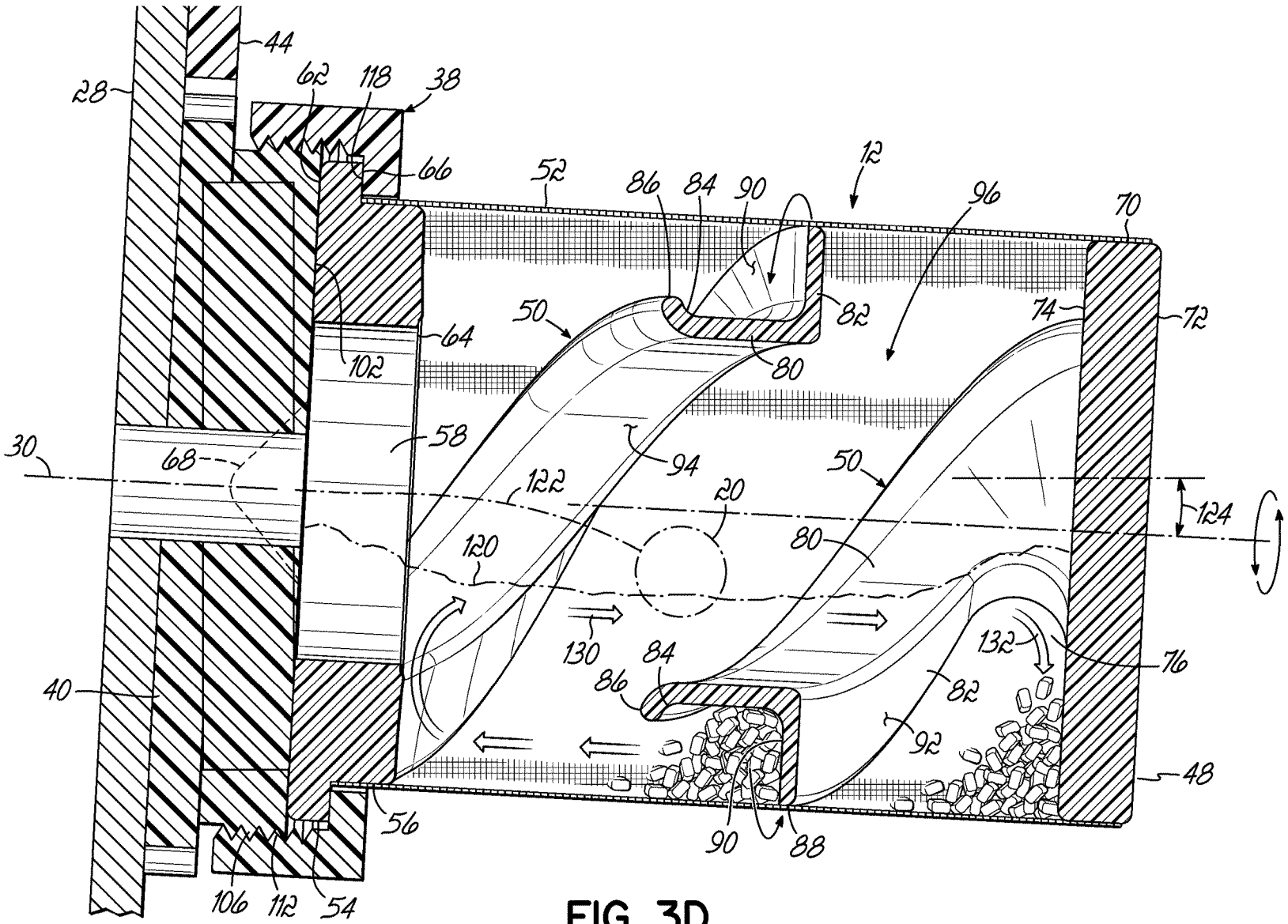
FIG. 3D is a view similar to FIGS. 3B and 3C further illustrating an alternative embodiment of the invention.

Referring to FIGS. 3B-3D, an enlarged view of the electroplating barrel 12 is shown in operation. In this regard, the electroplating apparatus 10 is configured to rotate the electroplating barrel 12 in a counterclockwise direction about the axis of rotation 30. In operation, the articles 120 are advanced from the distal end 48 to the proximal end 46 of the electroplating barrel 12 by the helical ribs 50. In this regard, as the electroplating barrel 12 rotates, the inlet 76 of the helical rib 50 turns over and engages the bed articles 120, capturing articles 120 in a portion of the pocket 98 and a larger portion of articles 120 in the receiving space 100. As the electroplating barrel 12 continues to rotate, the articles 120 captured in the pocket 98 are engaged by the pushing surface 90 of the flange 82, and the channel 80, and are moved there along in an axial direction towards the proximal end 46 of the electroplating barrel 12, indicated by arrows 126. The articles 120 in the pocket 98 engage and push the articles 120 in the receiving space 100 in a similar axial direction. Although the articles 120 are being moved axially, the parts may also be partially carried up the outer wall 52 of the electroplating barrel 12 as it rotates. As shown, the curved surface 84 and leading edge 86 are configured to retain articles 120 in the pocked as they are axially moved along the electroplating barrel 12. As the articles 120 near the proximal end 46 of the electroplating barrel 12, the receiving space 100 narrows and articles 120 are pushed upwardly or turned over, indicated by arrow 128, and disposed into the central axial opening 96 of the electroplating barrel 12. Through continued rotation of the electroplating barrel 12, parts are continually pushed in an upwardly direction 128 from the receiving space 100 and, ultimately, from the pocket 98, as the articles 120 encounter outlet 78 of the helical rib 50. The continual disposal of parts into the axial opening of the electroplating barrel 12 results in the articles 120 moving therethrough, in a direction indicated by arrows 130, from the proximal end 46 to the distal end 48 of the electroplating barrel 12. In this regard, the articles 120 flow over the back surfaces 94 of the helical ribs 50 and the articles 120 captured in the receiving spaces 100 until reaching the distal end 48 of the electroplating barrel 12, at which point the articles 120 are recirculated, as indicated by arrow 132, to repeat the process. However, articles 120 may not travel the entire axial distance between the proximal end 46 and distal end 48 of the electroplating barrel 12 and may be intermittently recirculated as they fall back into the receiving spaces 100.

As set forth above and with reference to FIG. 3D, the electroplating barrel 12 may be positioned at an angle 124 wherein the distal end 48 of the electroplating barrel 12 is positioned lower than the proximal end 46. In this regard, the helical ribs 50 may axially move the articles 120 in a similar manner as discussed above, in an upwardly or "uphill" direction, from the distal end 48 to the proximal end 46 as the electroplating barrel 12 is rotated. As the articles 120 are introduced into the central axial opening 96 at the proximal end 46 of the electroplating barrel 12, the angle 124 of the electroplating barrel 12 facilitates recirculation and movement of the articles 120 within the central axial opening 96, from the proximal end 46 to the distal end 48 of the electroplating barrel 12. In this regard, the articles 120 may be, for example, more effectively recirculated such that more articles 120 travel the entire axial distance between the proximal and distal ends 46, 48, before being recirculated or recirculated at a faster rate, or both.

The axial and circumferential recirculation of the articles 120 within the electroplating barrel 12 during operation, as described above, results in increased exposure of the surface areas of the articles 120 to the electroplating solution 18 during the electroplating process. In this regard, the pockets 98 and receiving spaces 100 formed by the helical ribs 50 minimize uneven clumping of articles 120 within the electroplating barrel 12 and create a greater agitation and intimacy between the articles 120 and the electroplating solution 18. Furthermore, as the articles 120 are recirculated from the proximal end 46 to the distal end 48 within the electroplating barrel 12, the articles 120 are consistently advanced past the metal contact member 20, maximizing electrical contact between the articles 120 and the metal contact member 20 during the electroplating process. Additionally, as the electroplating barrel 12 is rotated, the configuration of the helical ribs 50 creates a pumping action of the electroplating solution 18. In this regard, the pumping action increases electroplating solution 18 circulation within the plating tank 16, facilitating the transfer of exhausted electroplating solution outwardly from within the electroplating barrel 12 and fresh solution into the electroplating barrel 12. However, movement of the articles 120 within the electroplating barrel 12 may be influenced by increasing or decreasing the amount of helical ribs 50 in the electroplating barrel 12, for example, as discussed in further detail below.

Figure 4A:
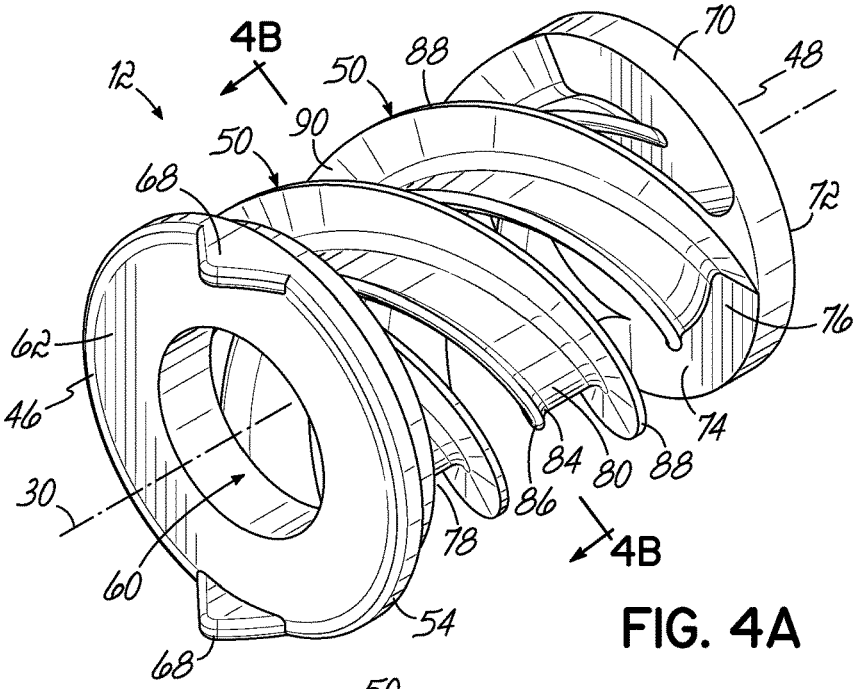
FIG. 4A illustrates a perspective view of an electroplating barrel having three helical ribs according to another embodiment of the present invention.
Figure 4B:
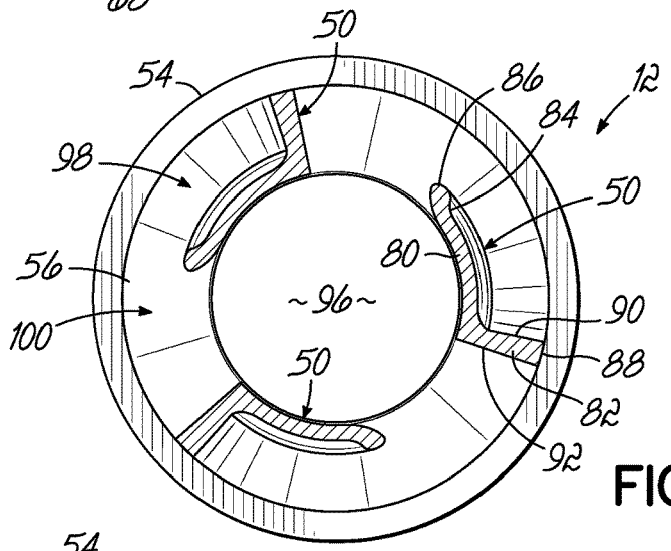
FIG. 4B illustrates a transverse sectional view taken along line 4B-4B of FIG. 2A.
Figure 4C:
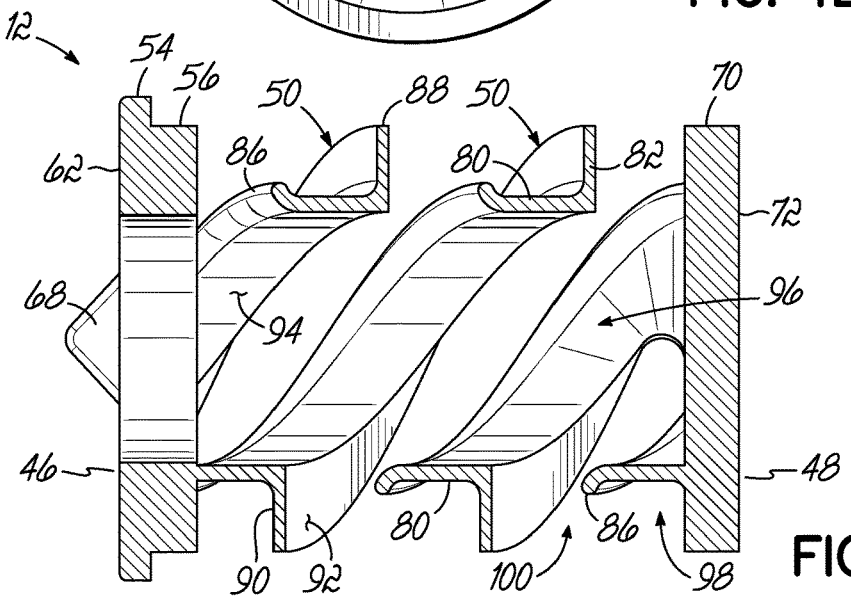
FIG. 4C illustrates a longitudinal cross-sectional side view of the embodiment shown in FIG. 4A.

With reference now to FIGS. 4A-4C, an alternative embodiment of the electroplating barrel 12 of FIGS. 1-3C is shown having three helical ribs 50. As discussed above, the size of the receiving space 100 may be influenced by the number of helical ribs 50 within the electroplating barrel 12. In the embodiment shown, the helical ribs 50 are spaced equidistantly around the proximal and distal ends 46, 48, of the electroplating barrel 12 and spirally extend therebetween. The significance of having a third helical rib 50 may be appreciated with reference to FIG. 4C. As shown, the helical ribs 50 are axially spaced closer together compared to the embodiment having two helical ribs 50 shown in FIGS. 3A-3C. In this regard, the distance between the pushing surface 90 of a portion of one helical rib 50 and the opposing trailing surface 92 of a portion of another helical rib 50 is less, resulting in a smaller receiving space 100. In the embodiment shown, the size of the receiving space 100 is substantially similar to the size of the pocket 98. During operation, the smaller receiving spaces 100 capture fewer articles as the electroplating barrel 12 rotates. This creates less clumping and increased tumbling of parts as they are advanced from the distal end 48 to the proximal end 46 of the electroplating barrel 12, providing for increased surface area exposure of each part to the plating solution during the electroplating process.

Figure 5A:
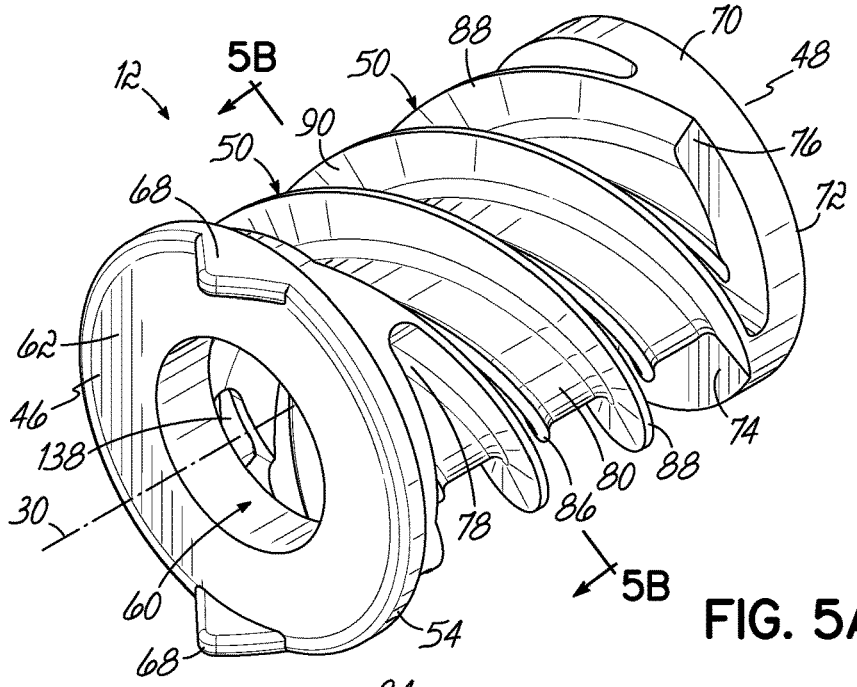
FIG. 5A illustrates a perspective view of an electroplating barrel having four helical ribs according to another embodiment of the present invention.
Figure 5B:
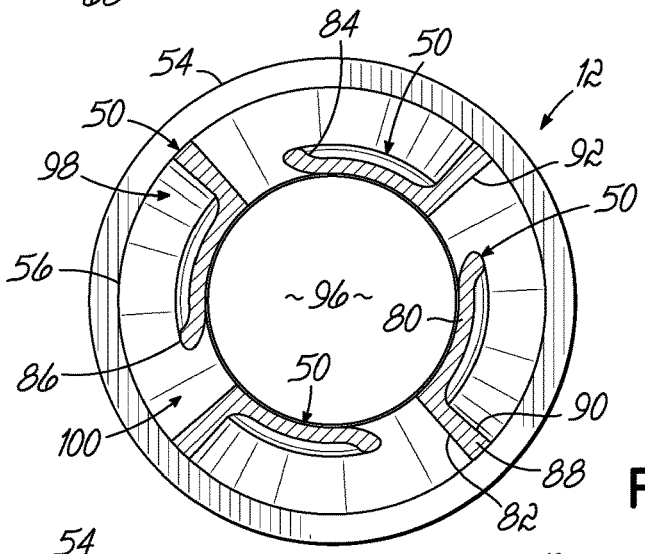
FIG. 5B illustrates a sectional view taken along line 5B-5B of FIG. 5A.
Figure 5C:
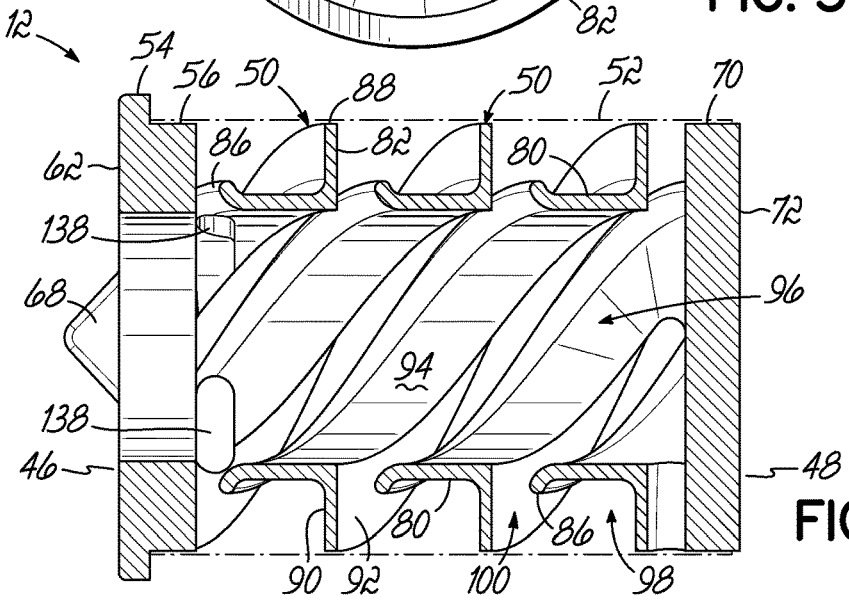
FIG. 5C illustrates a cross-sectional side view of the embodiment shown in FIG. 5A.

With reference now to FIGS. 5A-5C, yet another embodiment of the electroplating barrel 12 of FIGS. 1-3C is shown having a fourth helical rib 50. In the embodiment shown, the helical ribs 50 are spaced equidistantly around the proximal and distal ends 46, 48, of the electroplating barrel 12 and spirally extend therebetween, similar to the previous embodiments. As shown, having a fourth helical rib 50 further reduces the size of the receiving space 100 as a result of the helical ribs being axially spaced closer together. As a result, the receiving space 100 may be smaller than the size of the pocket 98 such that a majority of the articles captured therebetween may be captured in the pocket 98. In this regard, more captured articles may travel the entire axial distance between the proximal end 46 and distal end 48 of the electroplating barrel 12 before being recirculated into the central axial opening 96. As a result, this configuration may further facilitate the tumbling of articles, increasing the surface area exposure of each article to the electroplating solution 18 during operation of the electroplating barrel 12.

With specific reference to FIG. 5A, and to further facilitate recirculation of the articles into the central axial opening 96 at the proximal end 46 of the electroplating barrel 12, each helical rib 50 may further include an aperture or exit port 138 proximal to the outlet 78 of the helical rib 50. In the embodiment shown, the exit port 138 defines an opening extending through the channel 80 of the helical rib 50, wherein the exit port 138 is adjacent to, and shares a common side with the proximal end 46. The exit port 138 may also extend through a portion of the flange 88, or curved surface 84, or both. In the embodiment shown, where the helical ribs 50 are spaced closer together, the exit port 138 provides a passage for additional articles to pass from the receiving spaces 100 and, ultimately, from the pocket 98, and into the central axial opening 96 to be recirculated as the electroplating barrel 12 rotates.

Figure 6A:
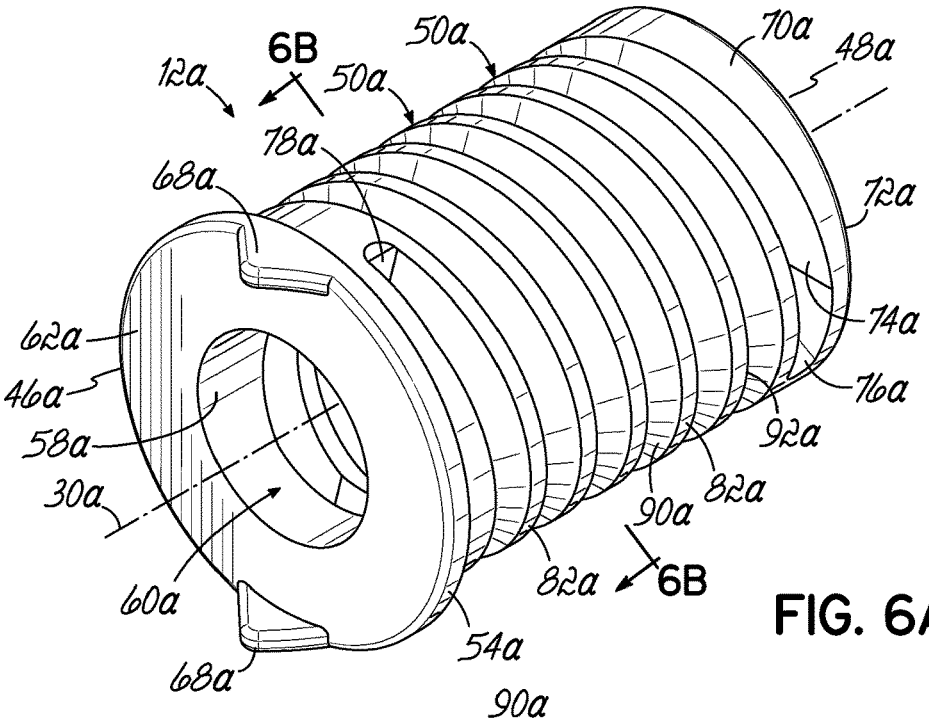
FIG. 6A illustrates a perspective view of an electroplating barrel according to an alternative embodiment of the present invention.
Figure 6B:
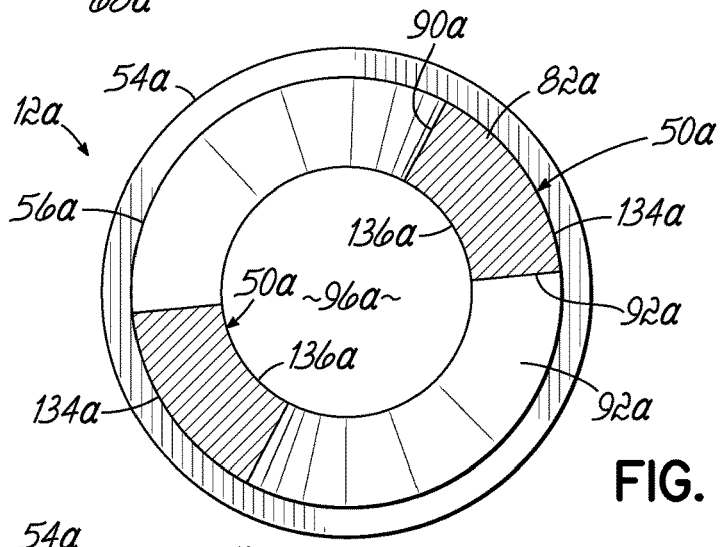
FIG. 6B illustrates a sectional view taken along line 6B-6B of FIG. 6A.
Figure 6C:
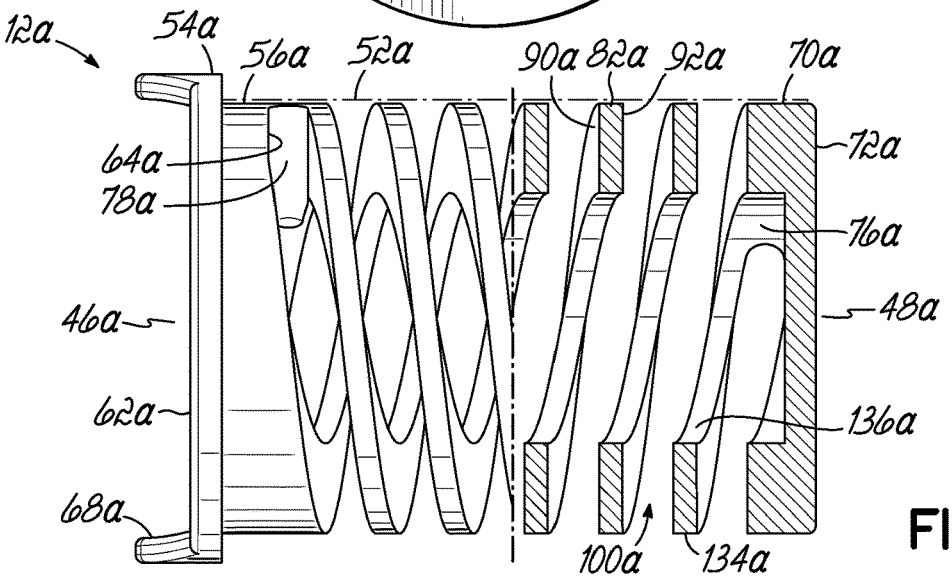
FIG. 6C illustrates a partial cross-sectional side view of the embodiment shown in FIG. 6A.

Referring now to FIGS. 6A-6C, in which like reference numerals refer to like features in FIGS. 1-5C, an electroplating barrel 12*a* in accordance with an alternative embodiment is shown. In the embodiment shown, the electroplating barrel 12*a* may be similar to the electroplating barrel 12 of FIGS. 1-5C in many respects, but differs in the configuration of the helical ribs 50. In the embodiment shown, the electroplating barrel 12*a* includes a proximal end 46*a*, a distal end 48*a*, and one or more helical ribs 50*a* extending helically along a longitudinal axis of rotation 30*a* of the electroplating barrel 12*a* and between the proximal and distal ends 46*a*, 48*a*. The distal end 48*a* of the electroplating barrel 12*a* is substantially cylindrical in shape, having an outer surface 70*a* extending between an end surface 72*a* and an internal surface 74*a*. The proximal end 46*a* of the electroplating barrel 12*a* includes a first and second 54*a*, 56*a*, generally cylindrical outer surfaces and a generally cylindrical and longitudinally extending inner surface 58*a* defined by a central aperture 60*a*, extending between a base surface 62*a* and an internal, raised surface 64*a*. The proximal end 46*a* may also include two tabs 68*a* projecting axially from the base surface 62*a*. The electroplating barrel 12*a* further includes a contiguous perforated outer wall 52*a*, as best shown in FIG. 6C, the perforated outer wall 52*a* extending between the proximal and distal ends 46*a*, 48*a*, of the electroplating barrel 12*a* and configured to wrap circumferentially around the electroplating barrel 12*a* and be affixed thereto. In this regard, the outer wall 52*a* forms a cylinder to surround the helical ribs 50*a* and enclose the electroplating barrel 12*a*. The helical rib 50*a*, proximal end 46*a*, and distal end 48*a* of the electroplating barrel 12*a* may be formed integrally as a unitary piece. The elements that form the electroplating barrel 12*a* of this embodiment may be constructed from materials substantially similar to like features of the previous embodiments discussed above.

With continued reference to FIGS. 6A-6C, the electroplating barrel 12*a* includes two helical ribs 50*a* extending between the proximal and distal ends 46*a*, 48*a*, in a clockwise direction. As shown, the helical ribs 50*a* may extend helically along the longitudinal axis of rotation 30*a* of the electroplating barrel 12*a*, extending from an inlet 76*a* formed on the inner surface 74*a* of the distal end 48*a* to an outlet 78*a* formed on the inner surface 58*a* of the proximal end 46*a*. In the embodiment shown, each helical rib 50*a* extends for greater than one full revolution (e.g., greater than 360 degrees) about the longitudinal axis of rotation 30*a* of the electroplating barrel 12*a*. However, in alternative embodiments, the electroplating barrel 12*a* may include more or less helical ribs 50*a* and the helical rib(s) 50*a* may extend for greater or less than one full revolution (e.g., greater or less than 360 degrees) about the longitudinal axis of rotation 30*a*.

In the embodiment shown, each helical rib 50*a* may be formed with a flange 82*a* having a pushing surface 90*a* and a diametrically opposed trailing surface 92*a*. The pushing and trailing surfaces 92*a* extend between an outer surface 134*a* and an inner surface 136*a*, the inner surface 136*a* positioned radially inwardly relative to the outer surface 134*a*, defining a height of the flange 82*a* therebetween. The outer surface 134*a* of the flange 82*a* may be adjacent or abut the outer wall 52*a* such that articles may not pass therebetween. In an alternative embodiment, the outer wall 52*a* may be secured to the flange 82*a* at the outer surface 134*a*. As the helical rib 50*a* extends around the longitudinal axis 30*a*, the pitch of the helical rib 50*a* and, more particularly the flange 82*a*, may vary so that the outer and inner surfaces 134*a*, 136*a*, remain generally parallel to the outer wall 52. In this regard, and as best shown in FIG. 6B, the inner surface 136*a* of the helical ribs 50*a* spirals about the longitudinal axis of rotation 30*a* and defines a central axial opening or cavity 96*a* which extends the length of the electroplating barrel 12*a*, from the distal end 48*a* to the proximal end 46*a*. The central axial opening 96*a* is generally cylindrical in in shape and, in the embodiment shown, corresponds to the shape of the central aperture 60*a* formed in the proximal end 46*a*. In this regard, the radial height of the flange 82*a* generally corresponds to the wall thickness of the internal surface 64*a* of the proximal end 46*a*. Accordingly, the helical rib 50*a* may project from the internal surface 74*a* of the distal end 48*a* such that the outer surface 134*a* of the flange 82*a* is coplanar with, and forms a smooth, continuous extensions of the outer surface 70*a* of the distal end 48*a*. The extension of the outer surface 70*a* of the distal end 48*a* may be flared and taper to the outer surface 134*a* of the flange 82*a* such that the edges remain rounded and smoothly curved. Likewise, the helical rib 50*a* may project from the internal surface 64*a* of the proximal end 46*a* such that the outer surface 134*a* of the flange 82*a* is coplanar with the second outer surface 56*a*, and forms a smooth, continuous extensions of the second outer surface 56*a*.

As best shown in FIG. 6C, the pushing surface 90*a* of a portion of one helical rib 50*a* cooperates with the opposing trailing surface 92*a* of a portion of another helical rib 50*a* and the outer wall 52*a*, to form a receiving space 100*a* therebetween. In the embodiment shown, the helical ribs 50*a* define a plurality of receiving spaces 100*a* along the length of the electroplating barrel 12*a*, the size of which may vary depending on the revolutions of the helical ribs 50*a* and the radial height of the flange 82*a*. During an electroplating process similar to the process described above, the predetermined quantity of articles contained within the electroplating barrel 12*a* may be captured in the receiving spaces 100*a* and advanced from the distal end 48*a* to the proximal end 46*a* as the electroplating barrel 12*a* rotates. Furthermore, the increased number of revolutions or spirals of the helical ribs 50*a* results in the flanges 82*a* being spaced closer together along the length of the electroplating barrel 12*a*. In this regard, the inner surface 136*a* of the helical ribs 50*a* provides for more surface area to facilitate the advancement or recirculation of articles from the proximal end 46*a* to the distal end 48*a* via the central axial opening 96*a*. To this end, more recirculated articles may travel the entire distance from the proximal end 46*a* to the distal end 48*a* of the electroplating barrel 12*a* during operation.

Figure 7A:
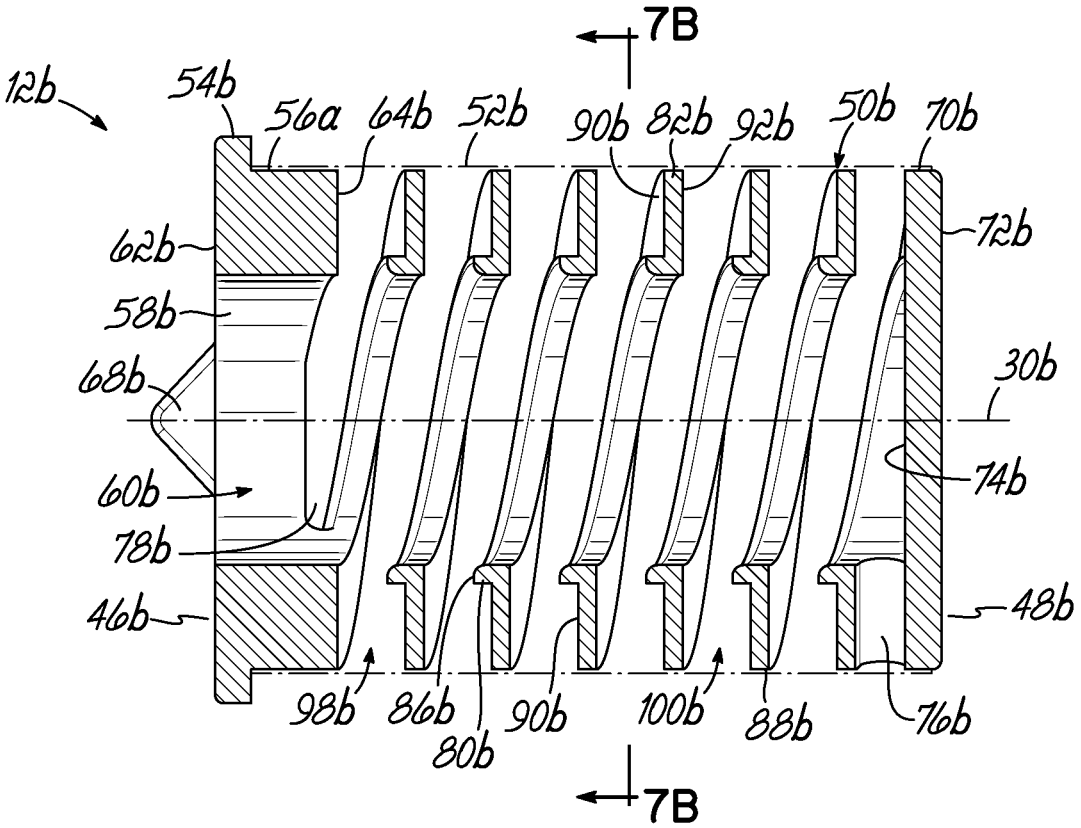
FIG. 7A illustrates a perspective view of an electroplating barrel according to another alternative embodiment of the present invention.
Figure 7B:
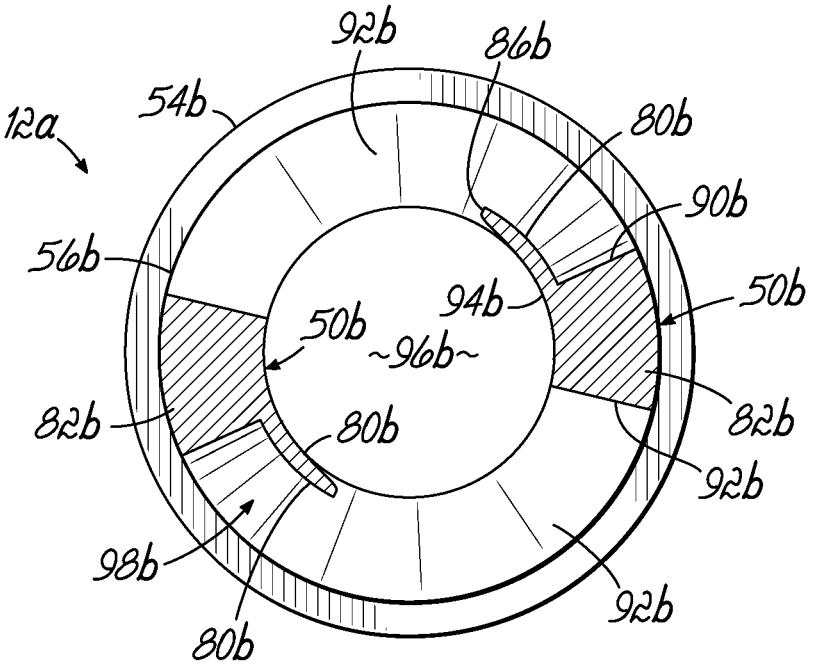
FIG. 7B illustrates a sectional view taken along line 7B-7B of FIG. 7A.

Referring now to FIGS. 7A-7B, in which like reference numerals refer to like features in FIGS. 1-5C, an electroplating barrel 12*b* in accordance with another alternative embodiment is shown. In the embodiment shown, the electroplating barrel 12*b* may be similar to the electroplating barrel 12 of FIGS. 1-5C in many respects, but differs in the configuration of the helical ribs 50. In the embodiment shown, the electroplating barrel 12*b* includes a proximal end 46*b*, a distal end 48*b*, and a helical rib 50*b* extending helically along the longitudinal axis of rotation 30*b* of the electroplating barrel 12*b* and between the proximal and distal ends 46*b*, 48*b*. The distal end 48*b* of the electroplating barrel 12*b* is substantially cylindrical in shape, having an outer surface 70*b* extending between an end surface 72*b* and an internal surface 74*b*. The proximal end 46*b* of the electroplating barrel 12*b* includes a first and second outer surface 54*b*, 56*b*, having a generally cylindrical shape and a longitudinally extending inner surface 58*b* defined by a central aperture 60*b*, extending between a base surface 62*b* and an internal, raised surface 64*b*. The proximal end 46*b* may also include two tabs 68*b* projecting axially from the base surface 62*b*. The electroplating barrel 12*b* further includes a perforated outer wall 52*b*, as best shown in FIG. 7A, the perforated outer wall 52*b* extending between the proximal and distal ends 46*b*, 48*b*, of the electroplating barrel 12*b* and configured to wrap circumferentially around the electroplating barrel 12*b* and be affixed thereto. In this regard, the outer wall 52*b* forms a cylinder to surround the helical ribs 50*b* and enclose the electroplating barrel 12*b*. The helical ribs 50*b*, proximal end 46*b*, and distal end 48*b* of the electroplating barrel 12*b* may be formed integrally as a unitary piece. The elements that form the electroplating barrel 12*b* of this embodiment may be constructed from materials substantially similar to like features of the previous embodiments discussed above.

With continued reference to FIGS. 7A-7B, the helical ribs 50*b* are shown extending between the proximal and distal ends 46*b*, 48*b*, in a clockwise direction. In this regard, the helical ribs 50*b* may extend helically along the longitudinal axis of rotation 30*b* of the electroplating barrel 12*b*, extending from an inlet 76*b* formed on the inner surface 74*b* of the distal end 48*b* to an outlet 78*b* formed on the inner surface 58*b* of the proximal end 46*b*. In the embodiment shown, the helical ribs 50*b* extends for greater than one full revolution (e.g., greater than 360 degrees) about the longitudinal axis of rotation 30*b* of the electroplating barrel 12*b*. However, in alternative embodiments, the electroplating barrel 12*b* may include more or less helical ribs 50*b* and the helical rib(s) 50*b* may extend for greater or less than one full revolution (e.g., greater or less than 360 degrees) about the longitudinal axis 30*b*.

As shown, each helical rib 50*b* may be formed with an outwardly facing channel 80*b* having a predetermined axial width, the channel 80*b* extending between a flange 82*b* and an unrounded leading edge 86*b*. In the embodiment shown, the axial width of the channel 80*b* is substantially smaller than the radial height of the flange 82*b*. The helical ribs 50*b* further include a back surface 94*b*, diametrically opposed from the channel 80*b* and configured to round inwardly to the leading edge 86*b*. The flange 82*b* extends outwardly from the channel 80*b* to a trailing edge 88*b*, the flange 82*b* having a pushing surface 90*b* and a diametrically opposed trailing surface 92*b*. As shown, the flange 82*b* is generally perpendicular to the channel 80*b* such that the pushing surface 90*b* of the flange 82*b* may form a right angle with the channel 80*b*, for example. In this regard, the channel 80*b* is partially rectangular in shape and contains fewer curved surfaces compared to the previously discussed embodiments. The flange 82*b* may have a predetermined radial height configured to radially space the channel 80*b* inwardly from the outer wall 52*b*. In this regard, the trailing edge 88*b* of the flange 82*b* may be adjacent or abut the outer wall 52*b* such that articles may not pass therebetween. In an alternative embodiment, the outer wall 52*b* may be secured to the flange 82*b* at the trailing edge 88*b*. As the helical ribs 50*b* extend around the axis of rotation 30*b*, the pitch of each helical rib 50*b* and, more particularly the flange 82*b*, may vary so that the channel 80*b* generally faces the outer wall 52*b* to capture articles therebetween. In this regard, and as best shown in FIG. 7B, the back surface 94*b* of the helical ribs 50*b* spiral about the axis of rotation 30*b* and define a central axial opening or cavity 96*b* which extends the length of the electroplating barrel 12*b*, from the distal end 48*b* to the proximal end 46*b*. The central axial opening 96*b* is generally cylindrical in in shape and, in the embodiment shown, corresponds to the shape of the central aperture 60*b* formed in the proximal end 46*b*. In this regard, the radial height of the flange 82*b* generally corresponds to the wall thickness of the internal surface 64*b* of the proximal end 46*b*. Accordingly, the helical rib 50*b* may project from the internal surfaces 64*b*, 74*b*, of the proximal and distal ends 46*b*, 48*b*, in a similar manner as the previously discussed embodiments, to form a smooth, continuous extensions of the outer surfaces 56*b*, 70*b*.

As shown in FIGS. 7A-7B, each helical rib 50*b* is generally "L" shaped and forms a pocket 98*b* between the channel 80*b* and the outer wall 52*b* of the electroplating barrel 12*b* configured to capture articles therein. Additionally, the pushing surface 90*b* of a portion of one helical rib 50*b* cooperates with the opposing trailing surface 92*b* of a portion of another helical rib 50*b* and the outer wall 52*b*, to form a receiving space 100*b* therebetween. In the embodiment shown, the helical rib 50*b* defines a plurality of receiving spaces 100*b* along the length of the electroplating barrel 12*b*. As shown, the helical rib 50*b* may contain more revolutions or spirals, placing the flanges 82*b* closer together. In this regard, during an electroplating process similar to the process described above, a portion of a predetermined quantity of articles contained within the electroplating barrel 12*b* may be captured within the pockets 98*b* and receiving spaces 100*b* as the electroplating barrel 12*b* rotates. Accordingly, the pockets 98*b* cooperate with the receiving spaces 100*b*, to advance the articles captured therebetween, from the distal end 48*b* to the proximal end 46*b* as the electroplating barrel 12*b* rotates, as described in previous embodiments.

Figure 8A:
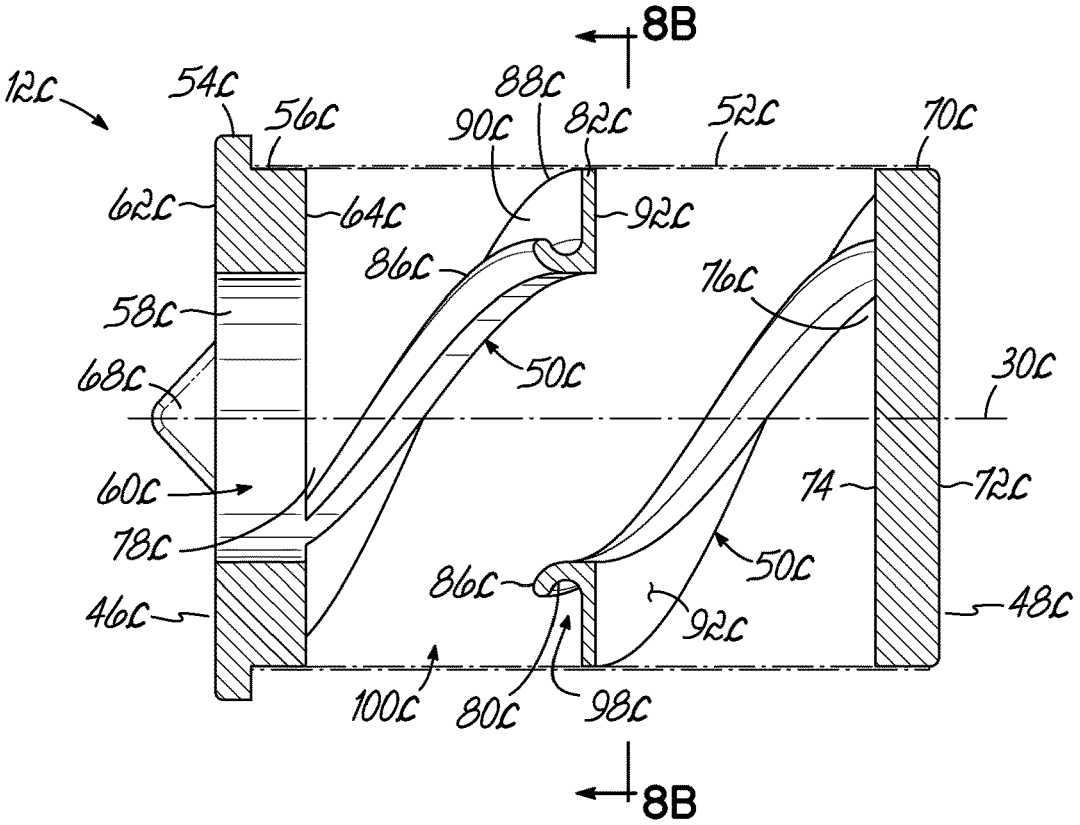
FIG. 8A illustrates a perspective view of an electroplating barrel according to another alternative embodiment of the present invention.
Figure 8B:
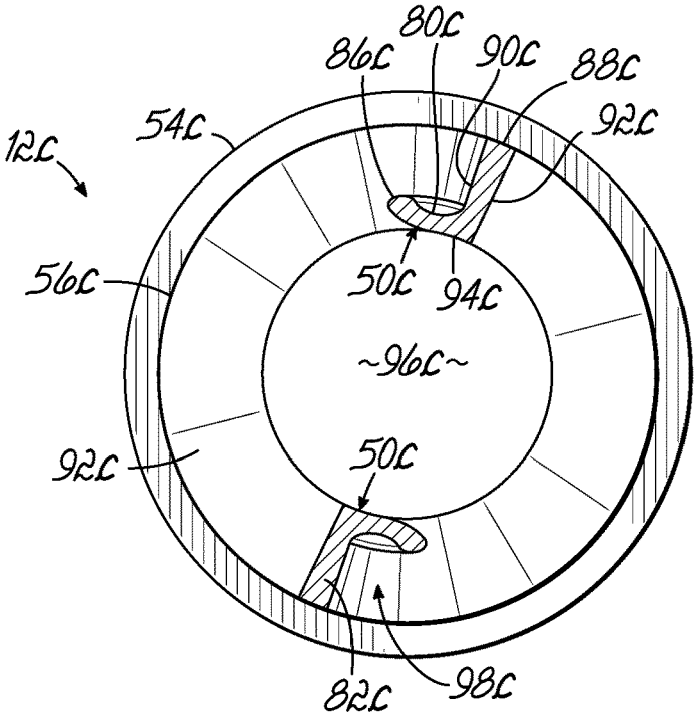
FIG. 8B illustrates a sectional view taken along line 8B-8B of FIG. 8A.

Referring now to FIGS. 8A-8B, in which like reference numerals refer to like features in FIGS. 1-5C, an electroplating barrel 12*c* in accordance with yet another alternative embodiment is shown. In the embodiment shown, the electroplating barrel 12*c* may be similar to the electroplating barrel 12 of FIGS. 1-5C in many respects, but differs in the configuration of the helical ribs 50. In the embodiment shown, the electroplating barrel 12*c* includes a proximal end 46*c*, a distal end 48*c*, and two helical ribs 50*c* extending helically along the axis of rotation 30*c* of the electroplating barrel 12*c* and between the proximal and distal ends 46*c*, 48*c*. The distal end 48*c* of the electroplating barrel 12*c* is substantially cylindrical in shape, having an outer surface 70*c* extending between an end surface 72*c* and an internal surface 74*c*. The proximal end 46*c* of the electroplating barrel 12*c* includes a first and second outer surface 54*c*, 56*c*, having a generally cylindrical shape and longitudinally extending inner surface 58*c* defined by a central aperture 60*c* extending between a base surface 62*c*, and an internal, raised surface 64*c*. The proximal end 46*c* may also include two tabs 68*c* projecting axially from the base surface 62*c*. The electroplating barrel 12*c* further includes a perforated outer wall 52*c* extending between the proximal and distal ends 46*c*, 48*c*, of the electroplating barrel 12*c* and configured to wrap circumferentially around the electroplating barrel 12*c* and be affixed thereto. In this regard, the outer wall 52*c* forms a cylinder to surround the helical ribs 50*c* and encloses the electroplating barrel 12*c*. The helical ribs 50*c*, proximal end 46*c*, and distal end 48*c* of the electroplating barrel 12*c* may be formed integrally as a unitary piece. The elements that form the electroplating barrel 12*c* of this embodiment may be constructed from materials substantially similar to like features of the previous embodiments discussed above.

With continued reference to FIGS. 8A-8B, the helical ribs 50*c* are shown extending between the proximal and distal ends 46*c*, 48*c*, in a clockwise direction. In this regard, the helical ribs 50*c* may extend helically along the axis of rotation 30*c* of the electroplating barrel 12*c*, extending from an inlet 76*c* formed on the inner surface 74*c* of the distal end 48*c* to an outlet 78*c* formed on the inner surface 58*c* of the proximal end 46*c*. In the embodiment shown, the helical ribs 50*c* extend for at least one full revolution (e.g., 360 degrees) about the axis of rotation 30*c* of the electroplating barrel 12*c*. However, in alternative embodiments, the electroplating barrel 12*c* may include more or less helical ribs 50*c* and the helical rib(s) 50*c* may extend for greater or less than one full revolution (e.g., greater or less than 360 degrees) about the longitudinal axis 30*c*.

The helical ribs 50*c* may be formed with an outwardly facing channel 80*c* having a predetermined axial width, the channel 80*c* extending between a flange 82*c* and a rounded leading edge 86*c*. The helical rib 50*c* further includes a back surface 94*c*, diametrically opposed from the channel 80*c* and configured to round inwardly to the leading edge 86*c*. In this regard, the channel 80*c* is generally arcuate in shape such that the leading edge 86*c* is rounded or curved outward towards the outer wall 52*c* of the electroplating barrel 12*c*. The flange 82*c* extends outwardly from the channel 80*c* to a trailing edge 88*c*, the flange 82*c* having a pushing surface 90*c* and a diametrically opposed trailing surface 92*c*. The flange 82*c* may have a predetermined radial height configured to radially space the channel 80*c* inwardly from the outer wall 52*c*. In this regard, the trailing edge 88*c* of the flange 82*c* may be adjacent or abut the outer wall 52*c* such that articles may not pass therebetween. In an alternative embodiment, the outer wall 52*c* may be secured to the helical ribs 50*c*, for example, at the flange 82*c*. As the helical ribs 50*c* extends around the axis of rotation 30*c*, the pitch of each helical rib 50*c* and, more particularly the flange 82*c*, may vary so that the channel 80*c* generally faces the outer wall 52*c* to capture articles therebetween. In this regard, the back surfaces 94*c* of the helical ribs spiral about the axis of rotation 30*c* and define a central axial opening or cavity 96*c* which extends the length of the electroplating barrel 12*c*, from the distal end 48*c* to the proximal end 46*c*. The central axial opening 96*c* is generally cylindrical in in shape and, in the embodiment shown, corresponds to the shape of the central aperture 60*c* formed in the proximal end 46*c*. In this regard, the radial height of the flange 82*c* generally corresponds to the wall thickness of the internal surface 64*c* of the proximal end 46*c*. Accordingly, the helical rib 50*c* may project from the internal surfaces 64*c*, 74*c*, of the proximal and distal ends 46*c*, 48*c*, in a similar manner as the previously discussed embodiments, to form a smooth, continuous extensions of the outer surfaces 56*c*, 70*c*.

As shown in FIGS. 8A-8B, the helical ribs 50*c* are generally "J" shaped, forming a pocket 98*c* between the channel 80*c* and the outer wall 52*c* of the electroplating barrel 12*c* configured to capture articles therein. Additionally, the pushing surface 90*c* of a portion of one helical rib 50*c* cooperates with the opposing trailing surface 92*c* of a portion of another helical rib 50*c* and the outer wall 52*c*, to form a receiving space 100*c* therebetween. As shown, the helical ribs 50*c* define fewer receiving spaces 100*c* therebetween compared to previously discussed embodiments. In this regard, more articles may be captured in the receiving spaces 100*c* and, as a result, fewer rotations of the electroplating barrel 12*c* may be required to advance the captured articles from distal end 48*c* to the proximal end 46*c* of the electroplating barrel 12*c* during operation. Accordingly, the recirculation of parts within the electroplating barrel 12*c* may be increased. In this regard, the "J" shape of the channel 80*c* facilitates the retention of articles within the pocket 98*c* and the receiving spaces 100*c*.

The helical ribs 50*c* define a plurality of receiving spaces 100*c* along the length of the electroplating barrel 12*c*. As a result of the configuration shown in this embodiment, the helical ribs 50*c* may contain more revolutions or spirals, placing the flanges 82*c* closer together. In this regard, during an electroplating process similar to the process described above, a portion of a predetermined quantity of articles contained within the electroplating barrel 12*c* may be captured within the pockets 98*c* and receiving spaces 100*c*. Accordingly, the pockets 98*c* cooperate with the receiving spaces 100*c*, in a similar manner as set forth above, to advance the articles captured therebetween as the electroplating barrel 12*c* rotates, from the distal end 48*c* to the proximal end 46*c* to be recirculated back to the distal end 48*c* via the central axial opening 96*c*.

While various embodiments have been described herein, it should be apparent that various modifications, alterations, and adaptations to those embodiments may occur to persons skilled in the art with attainment of at least some of the advantages. The disclosed embodiments are therefore intended to include all such modifications, alterations, and adaptations without departing from the scope of the embodiments as set forth herein.

In accordance with these and other possible variations and adaptations of the present invention, the scope of the invention should be determined in accordance with the following claims, only, and not solely in accordance with that embodiment within which the invention has been taught.

What is claimed is:

1. A rotatable electroplating barrel for electroplating articles, comprising:

a proximal end having a base and a raised internal surface with a centrally formed aperture therebetween, and at least one tab projecting from the base;

a distal end;

at least one helical rib extending circumferentially along a longitudinal axis and between the proximal end and the distal end; and a contiguous perforated outer wall coupled directly to the proximal and distal ends, extending therearound to enclose the at least one helical rib, wherein the at least one helical rib further comprises a radially extending flange having a pushing surface and a diametrically opposed trailing surface, the pushing and trailing surfaces extending between an axially extending outer surface and a diametrically opposed inner surface.

2. The electroplating barrel of claim 1, wherein the helical rib extends at least 360 degrees about the longitudinal axis of the electroplating barrel.

3. The electroplating barrel of claim 1, wherein the proximal end includes a plurality of tabs equidistantly spaced about a perimeter of the base.

4. The electroplating barrel of claim 1, wherein the helical rib extends for less than 360 degrees about the longitudinal axis of the electroplating barrel.

5. The electroplating barrel of claim 1, wherein the helical rib, proximal end, and distal end are integrally formed together as a unitary piece.

6. The electroplating barrel of claim 1, wherein the distal end includes a centrally formed aperture covered by a perforated outer wall segment.

7. The electroplating barrel of claim 1, wherein the at least one helical rib forms a plurality of receiving spaces along a length of the electroplating barrel and between the pushing surface, the diametrically opposed trailing surface, and contiguous perforated outer wall, the plurality of receiving spaces configured to capture a portion of articles contained within the barrel and advance the portion of articles from the distal end to the proximal end as the barrel rotates.

8. A rotatable electroplating barrel for electroplating articles, comprising:

a proximal end having a base and a raised internal surface with a centrally formed aperture therebetween, and at least one tab projecting from the base;

a distal end;

at least one helical rib extending circumferentially along a longitudinal axis and between the proximal end and the distal end; and a contiguous perforated outer wall coupled directly to the proximal and distal ends, extending therearound to enclose the at least one helical rib, wherein the at least one helical rib further comprises:

a radially extending flange defining a height of the at least one helical rib, the radially extending flange having a pushing surface, trailing surface, and trailing edge;

a channel projecting axially from the radially extending flange towards the proximal end and having a leading edge and an axial width defined by a distance between a plane defined by the radially extending flange and a plane defined by the leading edge; and a back surface diametrically opposed from the channel.

9. The electroplating barrel of claim 8, wherein the flange is adjacent to the contiguous perforated outer wall and radially spaces the channel inwardly from the outer wall.

10. The electroplating barrel of claim 8, wherein the back surface of the at least one helical rib defines a central axial opening which extends a length of the electroplating barrel between the proximal and distal ends.

11. The electroplating barrel of claim 10, wherein the central axial opening corresponds to the shape of the central aperture formed in the proximal end.

12. The electroplating barrel of claim 8, wherein the at least one helical rib further includes an inlet formed at the distal end and an outlet formed at the proximal end, wherein the at least one helical rib includes an exit port at the outlet.

13. The electroplating barrel of claim 8, wherein the at least one helical rib forms a pocket between the channel, pushing surface of the flange, and the contiguous perforated outer wall, the pocket configured to capture a portion of articles contained within the barrel and advance the portion of articles from the distal end to the proximal end as the barrel rotates.

14. The electroplating barrel of claim 8, wherein the at least one helical rib forms a plurality of receiving spaces along a length of the electroplating barrel and between the pushing surface, opposing trailing surface, and contiguous perforated outer wall, the plurality of receiving spaces configured to capture a portion of articles contained within the barrel and advance the portion of articles from the distal end to the proximal end as the barrel rotates.

15. The electroplating barrel of claim 8, wherein the axial width of the channel is less than the radial height of the flange.

16. The electroplating barrel of claim 8, wherein the axial width of the channel is greater than the radial height of the flange.

17. The electroplating barrel of claim 8, wherein the channel is arcuate in shape.

18. The electroplating barrel of claim 8, wherein the channel is partially rectangular in shape.

19. The electroplating barrel of claim 8, wherein the helical rib extends at least 360 degrees about the longitudinal axis of the electroplating barrel.

20. The electroplating barrel of claim 8, wherein the helical rib extends for less than 360 degrees about the longitudinal axis of the electroplating barrel.

21. The electroplating barrel of claim 8, wherein the helical rib, proximal end, and distal end are integrally formed together as a unitary piece.

22. The electroplating barrel of claim 8, wherein the proximal end includes a plurality of tabs equidistantly spaced about a perimeter of the base.

23. The electroplating barrel of claim 8, wherein the distal end includes a centrally formed aperture covered by a perforated outer wall segment.

* * * * *